US009173269B2

(12) United States Patent
Maxik et al.

(10) Patent No.: US 9,173,269 B2
(45) Date of Patent: Oct. 27, 2015

(54) LIGHTING SYSTEM FOR ACCENTUATING REGIONS OF A LAYER AND ASSOCIATED METHODS

(71) Applicant: LIGHTING SCIENCE GROUP CORPORATION, Satellite Beach, FL (US)

(72) Inventors: Fredric S. Maxik, Indialantic, FL (US); David E. Bartine, Cocoa, FL (US); Robert R. Soler, Cocoa Beach, FL (US); Mark Andrew Oostdyk, Cape Canaveral, FL (US); Addy S. Widjaja, Palm Bay, FL (US); Matthew Regan, Melbourne, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 0 days.

(21) Appl. No.: 14/275,371

(22) Filed: May 12, 2014

(65) Prior Publication Data

US 2014/0239818 A1 Aug. 28, 2014

Related U.S. Application Data

(63) Continuation-in-part of application No. 13/753,890, filed on Jan. 30, 2013, now Pat. No. 8,754,832, which is a continuation-in-part of application No. 13/709,942, filed on Dec. 10, 2012, now Pat. No.

(Continued)

(51) Int. Cl.
*G09G 5/00* (2006.01)
*G09G 5/10* (2006.01)
(Continued)

(52) U.S. Cl.
CPC ..... *H05B 33/0869* (2013.01); *F21S 10/023* (2013.01); *F21V 23/003* (2013.01); *H05B 33/086* (2013.01); *H05B 37/029* (2013.01)

(58) Field of Classification Search
CPC combination set(s) only.
See application file for complete search history.

(56) References Cited

U.S. PATENT DOCUMENTS 5,523,878 A 6/1996 Wallace et al.
5,680,230 A 10/1997 Kaburagi et al.
(Continued)

FOREIGN PATENT DOCUMENTS

CN 101 702 421 A 5/2010
DE 202011000007 U1 6/2012
(Continued)

OTHER PUBLICATIONS

U.S. Appl. No. 13/311,300, filed Dec. 2011, Fredric S. Maxik et al.
(Continued)

*Primary Examiner* — Wesner Sajous
(74) *Attorney, Agent, or Firm* — Mark Malek; Daniel Pierron; Widerman Malek, PL

(57) ABSTRACT

A lighting system for accenting a region of a target surface comprising a color matching engine, a plurality of light sources, a color capture device configured to measure light reflected by a target surface, and a computerized device configured to operate the plurality of light sources to emit an analysis light so as to be incident upon the target surface and identify a region of the target surface that reflects two or more wavelength ranges of light using a pattern recognition algorithm, defining a detected pattern having wavelength ranges. The color matching engine is configured to perform a matching operation that operates to determine dominant wavelength(s) of the wavelength ranges and polychromatic lights including or excluding dominant wavelength(s). The computerized device operates the light sources to emit a combined light being sequentially each of the polychromatic lights.

20 Claims, 10 Drawing Sheets

Related U.S. Application Data

8,760,370, and a continuation-in-part of application No. 13/107,928, filed on May 15, 2011, now Pat. No. 8,547,391, and a continuation-in-part of application No. 13/234,371, filed on Sep. 16, 2011, now Pat. No. 8,465,167, application No. 14/275,371, which is a continuation-in-part of application No. 13/792,354, filed on Mar. 11, 2013, now Pat. No. 8,901,850, which is a continuation-in-part of application No. 13/775,936, filed on Feb. 25, 2013.

(60) Provisional application No. 61/643,308, filed on May 6, 2012, provisional application No. 61/643,316, filed on May 6, 2012.

(51) Int. Cl.

| | |
|---|---|
| ***G09G 3/14*** | (2006.01) |
| ***G09G 3/16*** | (2006.01) |
| ***G09G 3/30*** | (2006.01) |
| ***G09G 3/36*** | (2006.01) |
| ***G02F 1/1335*** | (2006.01) |
| ***G02F 1/33*** | (2006.01) |
| ***G02B 26/00*** | (2006.01) |
| ***H04N 3/12*** | (2006.01) |
| ***H04J 14/02*** | (2006.01) |
| ***H05B 33/08*** | (2006.01) |
| ***F21V 23/00*** | (2015.01) |
| ***F21S 10/02*** | (2006.01) |
| *H05B 37/02* | (2006.01) |

(56) References Cited

U.S. PATENT DOCUMENTS

| | | | | |
|---|---|---|---|---|
| 5,704,701 | A | 1/1998 | Kavanagh et al. | |
| 5,813,753 | A | 9/1998 | Vriens et al. | |
| 5,915,279 | A * | 6/1999 | Cantrall et al. | 73/800 |
| 5,997,150 | A | 12/1999 | Anderson | |
| 6,140,646 | A | 10/2000 | Busta et al. | |
| 6,259,572 | B1 | 7/2001 | Meyer, Jr. | |
| 6,341,876 | B1 | 1/2002 | Moss et al. | |
| 6,356,700 | B1 | 3/2002 | Strobl | |
| 6,373,573 | B1 * | 4/2002 | Jung et al. | 356/419 |
| 6,459,919 | B1 | 10/2002 | Lys et al. | |
| 6,528,954 | B1 | 3/2003 | Lys et al. | |
| 6,550,949 | B1 | 4/2003 | Bauer et al. | |
| 6,561,656 | B1 | 5/2003 | Kojima et al. | |
| 6,577,080 | B2 | 6/2003 | Lys et al. | |
| 6,586,882 | B1 | 7/2003 | Harbers | |
| 6,594,090 | B2 | 7/2003 | Kruschwitz et al. | |
| 6,733,135 | B2 | 5/2004 | Dho | |
| 6,734,639 | B2 | 5/2004 | Chang et al. | |
| 6,762,562 | B2 | 7/2004 | Leong | |
| 6,767,111 | B1 | 7/2004 | Lai | |
| 6,787,999 | B2 | 9/2004 | Stimac et al. | |
| 6,817,735 | B2 | 11/2004 | Shimizu et al. | |
| 6,870,523 | B1 | 3/2005 | Ben-David et al. | |
| 6,871,982 | B2 | 3/2005 | Holman et al. | |
| 6,909,377 | B2 | 6/2005 | Eberl | |
| 6,967,761 | B2 | 11/2005 | Starkweather et al. | |
| 6,974,713 | B2 | 12/2005 | Patel et al. | |
| 7,009,343 | B2 | 3/2006 | Lim et al. | |
| 7,012,542 | B2 | 3/2006 | Powell et al. | |
| 7,034,934 | B2 | 4/2006 | Manning | |
| 7,042,623 | B1 | 5/2006 | Huibers et al. | |
| 7,058,197 | B1 | 6/2006 | McGuire et al. | |
| 7,070,281 | B2 | 7/2006 | Kato | |
| 7,072,096 | B2 | 7/2006 | Holman et al. | |
| 7,075,707 | B1 | 7/2006 | Rapaport et al. | |
| 7,083,304 | B2 | 8/2006 | Rhoads | |
| 7,095,053 | B2 | 8/2006 | Mazzochette et al. | |
| 7,140,752 | B2 | 11/2006 | Ashdown | |
| 7,144,131 | B2 | 12/2006 | Rains | |
| 7,157,745 | B2 | 1/2007 | Blonder et al. | |
| 7,178,941 | B2 | 2/2007 | Roberge et al. | |
| 7,184,201 | B2 | 2/2007 | Duncan | |
| 7,556,406 | B2 | 2/2007 | Petroski et al. | |
| 7,187,484 | B2 | 3/2007 | Mehrl | |
| 7,213,926 | B2 | 5/2007 | May et al. | |
| 7,234,844 | B2 | 6/2007 | Bolta et al. | |
| 7,246,923 | B2 | 7/2007 | Conner | |
| 7,247,874 | B2 | 7/2007 | Bode et al. | |
| 7,252,408 | B2 | 8/2007 | Mazzochette et al. | |
| 7,255,469 | B2 | 8/2007 | Wheatley et al. | |
| 7,261,453 | B2 | 8/2007 | Morejon et al. | |
| 7,289,090 | B2 | 10/2007 | Morgan | |
| 7,300,177 | B2 | 11/2007 | Conner | |
| 7,303,291 | B2 | 12/2007 | Ikeda et al. | |
| 7,319,293 | B2 | 1/2008 | Maxik | |
| 7,319,298 | B2 | 1/2008 | Jungwirth et al. | |
| 7,324,076 | B2 | 1/2008 | Lee et al. | |
| 7,325,956 | B2 | 2/2008 | Morejon et al. | |
| 7,342,658 | B2 | 3/2008 | Kowarz et al. | |
| 7,344,279 | B2 | 3/2008 | Mueller et al. | |
| 7,349,095 | B2 | 3/2008 | Kurosaki | |
| 7,353,859 | B2 | 4/2008 | Stevanovic et al. | |
| 7,369,056 | B2 | 5/2008 | McCollough et al. | |
| 7,382,091 | B2 | 6/2008 | Chen et al. | |
| 7,382,632 | B2 | 6/2008 | Alo et al. | |
| 7,400,439 | B2 | 7/2008 | Holman | |
| 7,427,146 | B2 | 9/2008 | Conner | |
| 7,429,983 | B2 | 9/2008 | Islam | |
| 7,434,946 | B2 | 10/2008 | Huibers | |
| 7,436,996 | B2 | 10/2008 | Ben-Chorin et al. | |
| 7,438,443 | B2 | 10/2008 | Tatsuno et al. | |
| 7,476,016 | B2 | 1/2009 | Kurihara | |
| 7,478,922 | B2 | 1/2009 | Garbus | |
| 7,497,596 | B2 | 3/2009 | Ge | |
| 7,520,607 | B2 | 4/2009 | Casper et al. | |
| 7,520,642 | B2 | 4/2009 | Holman et al. | |
| 7,521,875 | B2 | 4/2009 | Maxik | |
| 7,524,097 | B2 | 4/2009 | Turnbull et al. | |
| 7,528,421 | B2 | 5/2009 | Mazzochette | |
| 7,530,708 | B2 | 5/2009 | Park | |
| 7,537,347 | B2 | 5/2009 | Dewald | |
| 7,540,616 | B2 | 6/2009 | Conner | |
| 7,556,376 | B2 | 7/2009 | Ishak et al. | |
| 7,573,210 | B2 | 8/2009 | Ashdown et al. | |
| 7,598,686 | B2 | 10/2009 | Lys et al. | |
| 7,598,961 | B2 | 10/2009 | Higgins | |
| 7,605,971 | B2 | 10/2009 | Ishii et al. | |
| 7,619,372 | B2 | 11/2009 | Garrity | |
| 7,626,755 | B2 | 12/2009 | Furuya et al. | |
| 7,633,093 | B2 | 12/2009 | Blonder et al. | |
| 7,633,779 | B2 | 12/2009 | Garrity et al. | |
| 7,637,643 | B2 | 12/2009 | Maxik | |
| 7,677,736 | B2 | 3/2010 | Kasazumi et al. | |
| 7,678,140 | B2 | 3/2010 | Brainard et al. | |
| 7,679,281 | B2 | 3/2010 | Kim et al. | |
| 7,684,007 | B2 | 3/2010 | Hull et al. | |
| 7,687,753 | B2 | 3/2010 | Ashdown | |
| 7,703,943 | B2 | 4/2010 | Li et al. | |
| 7,705,810 | B2 | 4/2010 | Choi et al. | |
| 7,708,452 | B2 | 5/2010 | Maxik et al. | |
| 7,709,811 | B2 | 5/2010 | Conner | |
| 7,719,766 | B2 | 5/2010 | Grasser et al. | |
| 7,728,846 | B2 | 6/2010 | Higgins et al. | |
| 7,732,825 | B2 | 6/2010 | Kim et al. | |
| 7,748,845 | B2 | 7/2010 | Casper et al. | |
| 7,759,854 | B2 | 7/2010 | Miller et al. | |
| 7,766,490 | B2 | 8/2010 | Harbers et al. | |
| 7,819,556 | B2 | 10/2010 | Heffington et al. | |
| 7,828,453 | B2 | 11/2010 | Tran et al. | |
| 7,828,465 | B2 | 11/2010 | Roberge et al. | |
| 7,832,878 | B2 | 11/2010 | Brukilacchio et al. | |
| 7,834,867 | B2 | 11/2010 | Sprague et al. | |
| 7,835,056 | B2 | 11/2010 | Doucet et al. | |
| 7,841,714 | B2 | 11/2010 | Grueber | |
| 7,845,823 | B2 | 12/2010 | Mueller et al. | |
| 7,855,376 | B2 | 12/2010 | Cantin et al. | |
| 7,871,839 | B2 | 1/2011 | Lee et al. | |
| 7,880,400 | B2 | 2/2011 | Zhoo et al. | |

(56) References Cited

U.S. PATENT DOCUMENTS

| | | | | |
|---|---|---|---|---|
| 7,889,430 | B2 | 2/2011 | El-Ghoroury et al. | |
| 7,906,789 | B2 | 3/2011 | Jung et al. | |
| 7,928,565 | B2 | 4/2011 | Brunschwiler et al. | |
| 7,972,030 | B2 | 7/2011 | Li | |
| 7,976,182 | B2 | 7/2011 | Ribarich | |
| 7,976,205 | B2 | 7/2011 | Grotsch et al. | |
| 8,016,443 | B2 | 9/2011 | Falicoff et al. | |
| 8,040,070 | B2 | 10/2011 | Myers et al. | |
| 8,047,660 | B2 | 11/2011 | Penn et al. | |
| 8,049,763 | B2 | 11/2011 | Kwak et al. | |
| 8,061,857 | B2 | 11/2011 | Liu et al. | |
| 8,070,302 | B2 | 12/2011 | Hatanaka et al. | |
| 8,076,680 | B2 | 12/2011 | Lee et al. | |
| 8,083,364 | B2 | 12/2011 | Allen | |
| 8,096,668 | B2 | 1/2012 | Abu-Ageel | |
| 8,096,675 | B1 | 1/2012 | Posselt | |
| 8,115,419 | B2 | 2/2012 | Given et al. | |
| 8,149,406 | B2 | 4/2012 | Bergman et al. | |
| 8,164,844 | B2 | 4/2012 | Toda et al. | |
| 8,182,106 | B2 | 5/2012 | Shin | |
| 8,182,115 | B2 | 5/2012 | Takahashi et al. | |
| 8,188,687 | B2 | 5/2012 | Lee et al. | |
| 8,192,047 | B2 | 6/2012 | Bailey et al. | |
| 8,207,676 | B2 | 6/2012 | Hilgers | |
| 8,212,836 | B2 | 7/2012 | Matsumoto et al. | |
| 8,243,278 | B2 | 8/2012 | Valois et al. | |
| 8,253,336 | B2 | 8/2012 | Maxik et al. | |
| 8,255,487 | B2 | 8/2012 | Valois et al. | |
| 8,256,921 | B2 | 9/2012 | Crookham et al. | |
| 8,264,172 | B2 | 9/2012 | Valois et al. | |
| 8,274,089 | B2 | 9/2012 | Lee | |
| 8,297,783 | B2 | 10/2012 | Kim | |
| 8,304,978 | B2 | 11/2012 | Kim et al. | |
| 8,310,171 | B2 | 11/2012 | Reisenauer et al. | |
| 8,314,569 | B2 | 11/2012 | Adamson et al. | |
| 8,319,445 | B2 | 11/2012 | McKinney et al. | |
| 8,324,808 | B2 | 12/2012 | Maxik et al. | |
| 8,324,823 | B2 | 12/2012 | Choi et al. | |
| 8,324,840 | B2 | 12/2012 | Shteynberg et al. | |
| 8,331,099 | B2 | 12/2012 | Geissler et al. | |
| 8,337,029 | B2 | 12/2012 | Li | |
| 8,378,574 | B2 | 2/2013 | Schlangen et al. | |
| 8,401,231 | B2 | 3/2013 | Maxik et al. | |
| 8,491,165 | B2 | 7/2013 | Bretschneider et al. | |
| 8,492,995 | B2 | 7/2013 | Maxik et al. | |
| 8,525,444 | B2 | 9/2013 | Van Duijneveldt | |
| 2002/0113555 | A1 | 8/2002 | Lys et al. | |
| 2004/0052076 | A1 | 3/2004 | Mueller et al. | |
| 2004/0093045 | A1 | 5/2004 | Bolta | |
| 2004/0119086 | A1 | 6/2004 | Yano et al. | |
| 2005/0189557 | A1 | 9/2005 | Mazzochette et al. | |
| 2005/0218780 | A1 | 10/2005 | Chen | |
| 2005/0267213 | A1 | 12/2005 | Gold et al. | |
| 2006/0002108 | A1 | 1/2006 | Ouderkirk et al. | |
| 2006/0002110 | A1 | 1/2006 | Dowling et al. | |
| 2006/0164005 | A1 | 7/2006 | Sun | |
| 2006/0200013 | A1* | 9/2006 | Smith et al. | 600/319 |
| 2006/0285193 | A1 | 12/2006 | Kimura et al. | |
| 2007/0013871 | A1 | 1/2007 | Marshall et al. | |
| 2007/0159492 | A1 | 7/2007 | Lo et al. | |
| 2007/0262714 | A1 | 11/2007 | Bylsma | |
| 2007/0273290 | A1* | 11/2007 | Ashdown et al. | 315/113 |
| 2008/0054822 | A1* | 3/2008 | Biwa | 315/291 |
| 2008/0119912 | A1 | 5/2008 | Hayes | |
| 2008/0143973 | A1 | 6/2008 | Wu | |
| 2008/0198572 | A1 | 8/2008 | Medendorp | |
| 2008/0232084 | A1 | 9/2008 | Kon | |
| 2009/0059585 | A1 | 3/2009 | Chen et al. | |
| 2009/0128781 | A1 | 5/2009 | Li | |
| 2009/0232683 | A1 | 9/2009 | Hirata et al. | |
| 2009/0273931 | A1 | 11/2009 | Ito et al. | |
| 2009/0303694 | A1 | 12/2009 | Roth et al. | |
| 2010/0001652 | A1 | 1/2010 | Damsleth | |
| 2010/0006762 | A1 | 1/2010 | Yoshida et al. | |
| 2010/0051976 | A1 | 3/2010 | Rooymans | |
| 2010/0053959 | A1 | 3/2010 | Ijzerman et al. | |
| 2010/0076250 | A1 | 3/2010 | Van Woudenberg et al. | |
| 2010/0084992 | A1 | 4/2010 | Valois et al. | |
| 2010/0096993 | A1* | 4/2010 | Ashdown et al. | 315/113 |
| 2010/0103389 | A1 | 4/2010 | McVea et al. | |
| 2010/0157573 | A1 | 6/2010 | Toda et al. | |
| 2010/0202129 | A1 | 8/2010 | Abu-Ageel | |
| 2010/0213859 | A1 | 8/2010 | Shteynberg et al. | |
| 2010/0231131 | A1 | 9/2010 | Anderson | |
| 2010/0231863 | A1 | 9/2010 | Hikmet et al. | |
| 2010/0244700 | A1 | 9/2010 | Chong et al. | |
| 2010/0244724 | A1 | 9/2010 | Jacobs et al. | |
| 2010/0244735 | A1 | 9/2010 | Buelow, II | |
| 2010/0244740 | A1 | 9/2010 | Alpert et al. | |
| 2010/0270942 | A1 | 10/2010 | Hui et al. | |
| 2010/0277084 | A1 | 11/2010 | Lee et al. | |
| 2010/0277316 | A1 | 11/2010 | Schlangen et al. | |
| 2010/0302464 | A1 | 12/2010 | Raring et al. | |
| 2010/0308738 | A1 | 12/2010 | Shteynberg et al. | |
| 2010/0315320 | A1 | 12/2010 | Yoshida | |
| 2010/0320927 | A1 | 12/2010 | Gray et al. | |
| 2010/0320928 | A1 | 12/2010 | Kaihotsu et al. | |
| 2010/0321641 | A1 | 12/2010 | Van Der Lubbe | |
| 2011/0012137 | A1 | 1/2011 | Lin et al. | |
| 2011/0080635 | A1 | 4/2011 | Takeuchi | |
| 2011/0309755 | A1* | 12/2011 | Wirth et al. | 315/151 |
| 2011/0310446 | A1 | 12/2011 | Komatsu | |
| 2012/0249013 | A1 | 10/2012 | Valois et al. | |
| 2012/0250137 | A1 | 10/2012 | Maxik et al. | |
| 2012/0280625 | A1 | 11/2012 | Zampini et al. | |
| 2012/0285667 | A1 | 11/2012 | Maxik et al. | |
| 2012/0286700 | A1 | 11/2012 | Maxik et al. | |
| 2013/0070439 | A1 | 3/2013 | Maxik et al. | |
| 2013/0120963 | A1 | 5/2013 | Holland et al. | |
| 2013/0223055 | A1 | 8/2013 | Holland et al. | |
| 2013/0257312 | A1 | 10/2013 | Maxik et al. | |

FOREIGN PATENT DOCUMENTS

| | | | |
|---|---|---|---|
| EP | 0851260 | | 7/1998 |
| EP | 1662583 | A1 | 5/2006 |
| JP | 2008226567 | | 9/2008 |
| WO | WO03098977 | | 11/2003 |
| WO | WO2004011846 | A1 | 2/2004 |
| WO | WO2006001221 | A1 | 1/2006 |
| WO | 2006105649 | A1 | 10/2006 |
| WO | WO2009/121539 | A1 | 10/2009 |
| WO | WO2012064470 | | 5/2012 |
| WO | WO2012135173 | | 10/2012 |
| WO | WO2012158665 | | 11/2012 |
| WO | PCT US 2012067916 | | 12/2012 |

OTHER PUBLICATIONS

U.S. Appl. No. 13/709,942, filed Dec. 2012, Fredric S. Maxik et al.
U.S. Appl. No. 13/715,085, filed Dec. 2012, Fredric S. Maxik et al.
U.S. Appl. No. 13/737,606, filed Jan. 2013, Fredric S. Maxik et al.
U.S. Appl. No. 13/739,665, filed Jan. 2013, Fredric S. Maxik et al.
U.S. Appl. No. 13/775,936, filed Feb. 2013, Fredric S. Maxik et al.
U.S. Appl. No. 13/792,354, filed Mar. 2013, Fredric S. Maxik et al.
U.S. Appl. No. 13/803,825, filed Mar. 2013, Fredric S. Maxik et al.
U.S. Appl. No. 13/832,459, filed Mar. 2013, Fredric S. Maxik et al.
U.S. Appl. No. 13/837,643, filed Mar. 2013, Fredric S. Maxik et al.
U.S. Appl. No. 13/842,875, filed Mar. 2013, Eric Holland et al.
Arthur P. Fraas, Heat Exchange Design, 1989, p. 60, John Wiley & Sons, Inc., Canada
Boeing, (Jul. 6, 2011), International Space Program, S684-13489 Revision A "ISS Interior Solid State Lighting Assembly (SSLA) Specification", Submitted to National Aeronautics and Space Administration, Johnson Space Center, Contract No. NAS15-10000, pp. 1-60.
Brainard, et al., (Aug. 15, 2001), "Action Spectrum for Melatonin Regulation in Humans: Evidence for a Novel Circadian Photoreceptor", The Journal of Neuroscience, 21(16):6405-6412.
Binnie et al. (1979) "Fluorescent Lighting and Epilepsy" Epilepsia 20(6):725-727.

(56) References Cited

OTHER PUBLICATIONS

Charamisinau et al. (2005) "Semiconductor laser insert with Uniform Illumination for Use in Photodynamic Therapy" Appl Opt 44(24):5055-5068.
ERBA Shedding Light on Photosensitivity, One of Epilepsy's Most Complex Conditions. Photosensitivity and Epilepsy. Epilepsy Foundation. Accessed: Aug. 28, 2009. http://www.epilepsyfoundation.org/aboutepilepsy/seizures/photosensitivity-/gerba.cfm.
Figueiro et al. (2004) "Spectral Sensitivity of the Circadian System" Proc. SPIE 5187:207.
Figueiro et al. (2008) "Retinal Mechanisms Determine the Subadditive Response to Polychromatic Light by the Human Circadian System" Neurosci Lett 438(2):242.
Gabrecht et al. (2007) "Desogn of a Light Deliver System for the Photodynamic Treatment of the Crohn's Disease" Proc. SPIE 6632:1-9.
H. A El-Shaikh, S. V, Garimella, "Enhancement of Air Jet Impingement Heat Transfer using Pin-Fin Heat Sinks", D IEEE Transaction on Components and Packaging Technology, June. 2000, vol. 23, No. 2.
Happawana et al. (2009) "Direct De-Ionized Water-Cooled Semiconductor Laser Package for Photodynamic Therapy of Esophageal Carcinoma: Design and Analysis" J Electron Pack 131(2):1-7.
Harding & Harding (1999) "Televised Material and Photosensitive Epilepsy" Epilepsia 40(Suppl. 4):65.
Jones, Eric D., Light Emitting Diodes (LEDS) for General Lumination, an Optoelectronics Industry Development Association (OIDA) Technology Roadmap, OIDA Report, Mar. 2001, published by OIDA in Washington D.C.
J.Y. San, C. H. Huang, M. H, Shu, "Impingement cooling of a confined circular air jet", In t. J. Heat Mass Transf., 1997. pp. 1355-1364, vol. 40.
Kuller & Laike (1998) "The Impact of Flicker from Fluorescent Lighting on Well-Being, Performance and Physiological Arousal" Ergonomics 41(4):433-447.
Lakatos (2006) "Recent trends in the epidemiology of Inflammatory Bowel Disease: Up or Down?" World J Gastroenterol 12(38):6102.
Mehta, Arpit, "Map Colors of a CIE Plot and Color Temperature Using an RGB Color Sensor", Strategic Applications Engineer, Maxim Integrated Products, A1026, p. 1-11, (2005).
N. T. Obot, W. J. Douglas, A S. Mujumdar, "Effect of Semi-confinement on Impingement Heat Transfer", Proc. 7th Int. Heat Transt Conf., 1982, pp. 1355-1364. vol. 3.
Ortner & Dorta (2006) "Technology Insight: Photodynamic Therapy for Cholangiocarcinoma" Nat Clin Pract Gastroenterol Hepatol 3(8):459-467.
Rea (2010) "Circadian Light" Circadian Rhythms 8(1):2.
Rea et al. (2010) "The Potential of Outdoor Lighting for Stimulating the Human Circadian System" Alliance for Solid-State Illumination Systems and Technologies (ASSIST), May 13, 2010, p. 1-11.
Rosco Laboratories Poster "Color Filter Technical Data Sheet:#87 Pale Yellow Green" (2001).
S. A Solovitz, L. D. Stevanovic, R. A Beaupre, "Microchannels Take Heatsinks to the Next Level", Power Eectronics Technology, Nov. 2006.
Stevens, (1987) "Electronic Power Use and Breast Cancer; A Hypothesis" Am J Epidemlol 125(4)556-561.
Tannith Cattermole, "Smart Energy Class controls light on demand", Gizmag.com, Apr. 18, 2010 accessed Nov. 1, 2011.
Topalkara et al. (1998) "Effects of flash frequency and repetition of intermittent photic stimulation on photoparoxysmal responses" Seizure 7(13):249-253.
Veitch & McColl (1995) "Modulation of Fluorescent Light: Flicker Rate and Light Source Effects on Visual Performance and Visual Comfort" Lighting Research and Technology 27:243-256.
Wang (2005) "The Critical Role of Light in Promoting Intestinal Inflammation and Crohn's Disease" J Immunol 174 (12):8173-8182.
Wilkins et al. (1979) "Neurophysical aspects of pattern-sensitive epilepsy" Brain 102:1-25.
Wilkins et al. (1989) "Fluorescent lighting, headaches, and eyestrain" Lighting Res Technol 21(1):11-18.
Yongmann M. Chung, Kai H. Luo, "Unsteady Heat Transfer Analysis of an Impinging Jet", Journal of Heat Transfer—Transactions of ASME, Dec. 2002, pp. 1039-1048, vol. 124, No. 6.
PCT International Search Report dated Dec. 9, 2013 as cited in related patent application PCT/US2013/039682 (4 pages).
United States Patent and Tradmark Office Office Action dated Jun. 22, 2015 cited in related U.S. Appl. No. 13/775,936 (51 pages).

* cited by examiner

LIGHTING SYSTEM FOR ACCENTUATING REGIONS OF A LAYER AND ASSOCIATED METHODS

RELATED APPLICATIONS

This application is a continuation-in-part and claims benefit under 35 U.S.C. §120 of U.S. patent application Ser. No. 13/753,890 titled Lighting System for Accentuating Regions of a Layer and Associated Methods filed Jan. 30, 2013, which is in turn a continuation-in-part of U.S. patent application Ser. No. 13/709,942 titled System for Generating Non-Homogenous Light and Associated Methods filed Dec. 10, 2012, which is, in turn, related to and claims the benefit of U.S. Provisional Patent Application Ser. No. 61/643,308 titled Tunable Light System and Associated Methods filed May 6, 2012, U.S. Provisional Patent Application Ser. No. 61/643,316 titled Luminaire Having an Adaptable Light Source and Associated Methods filed May 6, 2012, and is a continuation-in-part of U.S. patent application Ser. No. 13/107,928 titled High Efficacy Lighting Signal Converter and Associated Methods filed May 15, 2011, now U.S. Pat. No. 8,547,391 issued Oct. 1, 2013, and U.S. patent application Ser. No. 13/234,371 titled Color Conversion Occlusion and Associated Methods filed Sep. 16, 2011, now U.S. Pat. No. 8,465,167 issued Jun. 18, 2013, the contents of each of which are incorporated in their entirety herein except to the extent disclosure therein is inconsistent with disclosure herein. This application is also a continuation-in-part and claims benefit under 35 U.S.C. §120 of U.S. patent application Ser. No. 13/792,354 titled Adaptive Anti-Glare Light System and Associated Methods filed Mar. 11, 2013, which is in turn a continuation-in-part of U.S. patent application Ser. No. 13/775,936 titled Adaptive Light System and Associated Methods filed Feb. 25, 2013, the contents of each which are incorporated in its entirety herein except to the extent disclosure therein is inconsistent with disclosure herein.

FIELD OF THE INVENTION

The present invention relates to lighting systems that selectively emit light containing specific wavelength ranges and layers responsive to the emitted light, and associated methods.

BACKGROUND OF THE INVENTION

Making a picture, character, or otherwise identifiable image appear on a surface has usually involved the projection of the image on an otherwise blank surface. Moreover, the progression of a sequence of images, such as simulating motion, has tended to include either a series of projecting devices working in sequence to project the images, or a single projecting device that moves or rotates. However, such systems typically require the environment in which the image is to be perceived to be relatively darker, or the image may be difficult to perceive. Moreover, the projection of an image onto a non-blank surface makes the image difficult to recognize.

Images have been embedded in random, pseudo-random, or otherwise non-recognizable patterns. This is useful for entertainment, where an image becomes apparent where it once was not apparent. For example, autostereograms are well known. However, prior embedded images have typically relied on biological responses, such as the decoupling of eye convergence, in order for the embedded image to become apparent, and not all observers are able to accomplish such decoupling. Other systems rely on a filter to be positioned intermediate the embedded image and the observer, usually in the form of eyewear. These systems are generally undesirable, as the eyewear is not conducive to ordinary activities. Accordingly, there is a need for a system for eliciting embedded images without impeding the activity of the observer, and that is readily observable by all observers.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a lighting system for accenting a region of a target surface comprising a color matching engine, a plurality of light sources, a color capture device, and a computerized device operatively coupled to each of the color matching engine, the plurality of light sources, and the color capture device, and configured to individually operate each of the plurality of light sources. The computerized device may be configured to operate the plurality of light sources to emit an analysis light so as to be incident upon a target surface Additionally, the color capture device may be configured to measure light reflected by the target surface. Furthermore, the computerized device may be configured to identify a region of the target surface that reflects two or more wavelength ranges of light using a pattern recognition algorithm, defining a detected pattern comprising a first region having a first surface scatter profile associated with a first wavelength range and a second region having a second surface scatter profile associated with a second wavelength range. The color matching engine may be configured to perform a matching operation that operates to determine a first dominant wavelength of the first wavelength range and a second dominant wavelength of the second wavelength range, and to determine a first polychromatic light including the first dominant wavelength and excluding the second dominant wavelength, and a second polychromatic light including the second dominant wavelength and excluding the first dominant wavelength. Additionally, the computerized device may be configured to operate the plurality of light sources to emit a combined light being sequentially each of the first polychromatic light and the second polychromatic light.

In some embodiments, each light source may comprise a plurality of light-emitting diodes (LEDs). Furthermore, the combined light may be a white light. Additionally, the computerized device may be configured to operate the plurality of luminaires so as to sequentially emit the combined light first being the first polychromatic light for a first duration and second being the second polychromatic light for a second duration. A length of each of the first duration and the second duration is selected so as to simulate motion in a transition between the first region and the second region.

In some embodiments, the detected pattern may be defined as a first detected pattern, and the computerized device may be configured to identify a pattern of the target surface that reflects light outside the wavelength ranges associated with the first detected pattern using the pattern recognition algorithm, defining a second detected pattern comprising a third region having a third surface scatter profile associated with a third wavelength range and a fourth region having a fourth surface scatter profile associated with a fourth wavelength range. Furthermore, the color matching engine may be configured to perform a matching operation that operates to determine a third dominant wavelength of the third wavelength range and a fourth dominant wavelength of the fourth wavelength range.

In further embodiments, the color matching engine may be configured to determine a first polychromatic light including the first and third dominant wavelengths and excluding the second and fourth dominant wavelengths, and a second polychromatic light including the second and fourth dominant wavelengths and excluding the first and third dominant wavelengths. In other embodiments, the color matching engine may be configured to determine a first polychromatic light including the first dominant wavelength and excluding each of the second, third, and fourth dominant wavelengths, determine a second polychromatic light including the second dominant wavelength and excluding each of the first, third, and fourth dominant wavelengths, determine a third polychromatic light including the third dominant wavelength and excluding each of the first, second, and fourth dominant wavelengths, and determine a fourth polychromatic light including the fourth dominant wavelength and excluding each of the first, second, and third dominant wavelengths. Furthermore, the computerized device may be configured to operate the plurality of light sources to emit a combined light being sequentially each of the first polychromatic light, the second polychromatic light, the third polychromatic light, and the fourth polychromatic light. Additionally, the computerized device may be configured to operate the plurality of luminaires so as to sequentially emit a combined light being the first polychromatic light for a first duration, being the second polychromatic light for a second duration, being the third polychromatic light for a third duration, and being the fourth polychromatic light for a fourth duration; and wherein a length of each of the first duration, second duration, third duration, and fourth duration is selected so as to simulate motion in a transition between any of the first region, the second region, the third region, and the fourth region.

Additionally, embodiments of the present invention are directed to a lighting system for accenting a region of a target surface comprising a color matching engine, a plurality of light sources, the plurality of light sources comprising a first light source positioned at a first location and a second light source positioned at a second location, a color capture device, and a computerized device operatively coupled to each of the color matching engine, the plurality of light sources, and the color capture device, and configured to individually operate each of the plurality of light sources. The computerized device may be configured to operate the plurality of light sources to emit an analysis light so as to be incident upon a target surface. Furthermore, the color capture device may be configured to measure light reflected by the target surface. Additionally, the computerized device may be configured to identify a pattern of the target surface that reflects light within a wavelength range of light using a pattern recognition algorithm, defining a detected pattern having a first region and a second region having a first surface scatter profile associated with a first wavelength range.

The color matching engine may be configured to perform a matching operation that operates to determine a first dominant wavelength of the first wavelength range, and to determine a first polychromatic light including the first dominant wavelength and a second polychromatic light excluding the first dominant wavelength. Light emitted by the first light source is not incident upon the second region and light emitted by the second light source is not incident upon the first region. Furthermore, the computerized device may be configured to selectively operate the first light source and the second light source such that one of the first light source and the second light source emits the first polychromatic light while the other emits the second polychromatic light.

In some embodiments, each light source comprises a plurality of light-emitting diodes (LEDs). Furthermore, each of the first polychromatic light and the second polychromatic light may be a white light.

In some embodiments, the computerized device may be configured to sequentially operate the first and second light sources first such that the first light source emits the first polychromatic light and the second light source emits the second polychromatic light for a first duration, and second such that the first light source emits the second polychromatic light and the second light source emits the first polychromatic light for a second duration. A length of each of the first duration and the second duration is selected so as to simulate motion in a transition between the first region and the second region.

In some embodiments, the detected pattern may be defined as a first detected pattern, and the computerized device may be configured to identify a pattern of the target surface that reflects light within a wavelength range of using the pattern recognition algorithm, defining a second detected pattern comprising a third region and a fourth region having a second scatter profile associated with a second wavelength range. Furthermore, the color matching engine may be configured to perform a matching operation that operates to determine a second dominant wavelength of the second wavelength range.

In further embodiments, the color matching engine may be configured to determine a first polychromatic light including the first dominant wavelength and excluding the second dominant wavelength, a second polychromatic light including each of the first and second dominant wavelengths, a third polychromatic light including the second dominant wavelength and excluding the first dominant wavelength, and a fourth polychromatic light excluding each of the first and second dominant wavelengths. Light emitted by the first light source may be incident upon the first and third regions and not incident upon the second and fourth regions. Additionally, light emitted by the second light source may be incident upon the second and fourth regions and not incident upon the first and third regions; Furthermore, the computerized device may be configured to selectively operate the first light source and the second light source such that one of the first light source and the second light source emits the first polychromatic light while the other emits the fourth polychromatic light simultaneously, one of the first light source and the second light source emits the second polychromatic light while the other emits the fourth polychromatic light simultaneously, and one of the first light source and the second light source emits the third polychromatic light while the other emits the fourth polychromatic light simultaneously.

Additionally, embodiments of the present invention are directed to a lighting system for accenting a region of a target surface comprising a color matching engine, a plurality of light sources, the plurality of light sources comprising a first light source positioned at a first location and a second light source positioned at a second location, a color capture device, and a computerized device operatively coupled to each of the color matching engine, the plurality of light sources, and the color capture device, and configured to individually operate each of the plurality of light sources. The computerized device may be configured to operate the plurality of light sources to emit a polychromatic analysis light so as to be incident upon a target surface. Additionally, the color capture device may be configured to measure light reflected by the target surface. The computerized device may be configured to identify a region of the target surface that reflects light that is definable as a pattern using a pattern recognition algorithm, defining a detected pattern. Furthermore, the computerized device may be configured to determine if the detected pattern comprises a first region and a second region configured to reflect light within a first wavelength range or comprises a first region configured to reflect light within a first wavelength range and a second region configured to reflect light within a second wavelength range.

If the computerized device determines the detected pattern comprises first and second regions configured to reflect light within a same first wavelength range, the color matching engine may be configured to perform a matching operation that operates to determine a first dominant wavelength of the first wavelength range, and to determine a first polychromatic light including the first dominant wavelength and a second polychromatic light excluding the first dominant wavelength. Additionally, the computerized device may be configured to selectively operate the first light source and the second light source such that one of the first light source and the second light source emits the first polychromatic light while the other emits the second polychromatic light.

If the computerized device determines the detected pattern comprises a first region configured to reflect light within a first wavelength range and a second region configured to reflect light within a second wavelength range, the color matching engine may be configured to perform a matching operation that operates to determine a first dominant wavelength of the first wavelength range and a second dominant wavelength of the second wavelength range, and to determine a first polychromatic light including the first dominant wavelength and excluding the second dominant wavelength, and a second polychromatic light including the second dominant wavelength and excluding the first dominant wavelength. Additionally, the computerized device may be configured to operate the plurality of light sources to emit a combined light being one of the first polychromatic light and the second polychromatic light.

In some embodiments, each light source may comprise a plurality of light-emitting diodes (LEDs). Additionally, each of the first polychromatic light and the second polychromatic light may a white light.

If the computerized device determines the detected pattern comprises first and second regions configured to reflect light within the first wavelength range, the computerized device may be configured to sequentially operate the first and second light sources first such that the first light source emits the first polychromatic light and the second light source emits the second polychromatic light for a first duration, and second such that the first light source emits the second polychromatic light and the second light source emits the first polychromatic light for a second duration. A length of each of the first duration and the second duration is selected so as to simulate motion in a transition between the first region and the second region.

If the computerized device determines the detected pattern comprises a first region configured to reflect light within a first wavelength range and a second region configured to reflect light within a second wavelength range, the computerized device may be configured to operate the plurality of luminaires so as to sequentially emit a combined light first being the first polychromatic light for a first duration and second being the second polychromatic light for a second duration. A length of each of the first duration and the second duration is selected so as to simulate motion in a transition between the first region and the second region.

In some embodiments, the detected pattern may be defined as a first pattern, and the computerized device may be configured to identify a pattern of the target surface that reflects light within a second wavelength range of light using the pattern recognition algorithm, defining a second detected pattern. Furthermore, the computerized device may be configured to determine if the second detected pattern comprises a third region and a fourth region configured to reflect light within a third wavelength range or comprises a third region configured to reflect light within a third wavelength range and a fourth region configured to reflect light within a fourth wavelength range. If the computerized device determines the second detected pattern comprises a third region configured to reflect light within a third wavelength range and a fourth region configured to reflect light within a fourth wavelength range, the color matching engine may be configured to perform a matching operation that operates to determine a third dominant wavelength of the third wavelength range and a fourth dominant wavelength of the fourth wavelength range. If the computerized device determines the second detected pattern comprises a third region and a fourth region configured to reflect light within a third wavelength range, the color matching engine may be configured to perform a matching operation that operates to determine a third dominant wavelength of the third wavelength range.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
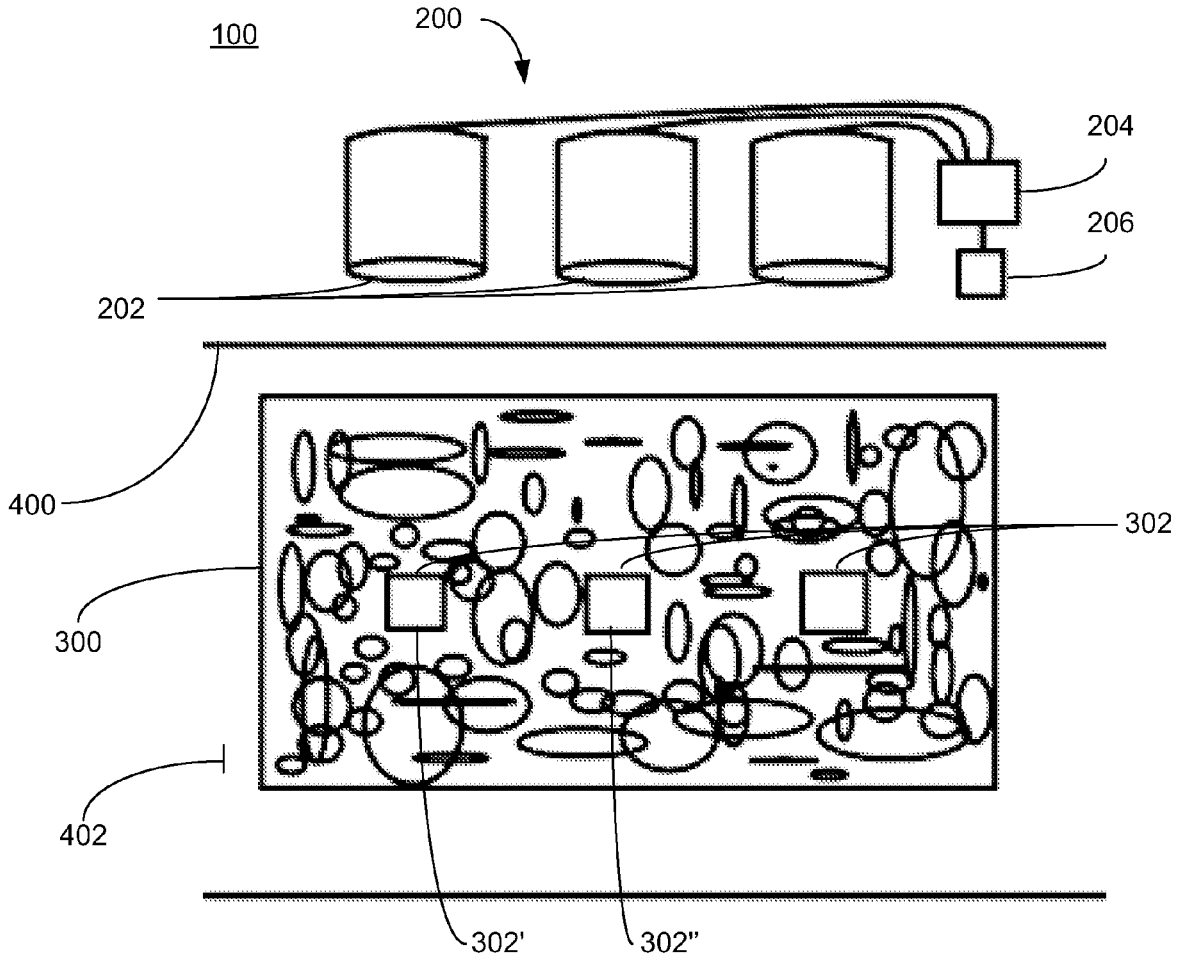
FIG. 1 is a side elevation view of a lighting system and surface according to an embodiment of the invention.

An embodiment of the invention, as shown and described by the various figures and accompanying text, provides a system 100 comprising a lighting system 200 and a layer 300, as shown in FIG. 1. The lighting system 200 may be configured to emit light having certain characteristics of light that interact with certain regions 302 of the layer 300 to accentuate those regions.

The lighting system 200 may comprise a plurality of light sources 202. The plurality of light sources 202 may each be a light-emitting device configured to emit light having certain light characteristics. Examples of light characteristics that may be controlled in the emission of light include wavelength, luminous intensity, color, and color temperature. Moreover, each light source 202 may be configured to emit monochromatic light or polychromatic light. Additionally, the plurality of light sources 202 may include a type of light source, including, but not limited to, an incandescent source, a fluorescent source, a light-emitting semiconductor such as a light-emitting diode (LED), a halogen source, an arc source, or any other light source known in the art. More information regarding the operation and characteristics of the plurality of light sources 202 may be found in U.S. patent application Ser. No. 13/709,942, the entire contents of which is incorporated by reference hereinabove.

Continuing to refer to FIG. 1, the layer 300 will now be discussed in greater detail. The layer 300 may be a layer of material configured to be applied to the surface 402 of a structure 400. Furthermore, the layer 300 may include one or more regions 302 that are configured to interact with light emitted by the lighting system 200 so as to be accentuated. In some embodiments, the layer 300 may comprise a first region 302' and a second region 302". The first region 302' may be configured to have a first surface scatter profile. More specifically, the first region 302' may be configured to reflect, scatter, diffusely reflect, diffusively scatter, or otherwise redirect light within a scattering wavelength range and absorb light outside the scattering wavelength range. Furthermore, the first region 302' may be configured to reflect, scatter, diffusely reflect, or otherwise redirect light having a certain scattering wavelength and absorb light having a different wavelength. The scattering wavelength range and the scattering wavelength may be associated with a color. Similarly, the second region 302" may have a second surface scatter profile that is configured to reflect, scatter, diffusely reflect, or otherwise redirect light within a certain scattering wavelength range and absorb light outside the scattering wavelength range, or reflect, scatter, diffusely reflect, or otherwise redirect light having a certain scattering wavelength and absorb light having a different wavelength. The scattering wavelength range and scattering wavelength may be associated with a color. Additionally, the first surface scatter profile may be configured to reflect, scatter, diffusely reflect, or otherwise redirect light associated with a color that is also the same as or similar to the color of light that the second surface scatter profile is configured to reflect, scatter, diffusely reflect, or otherwise redirect, or it may be of a different color.

The first region 302' and the second region 302" may be positioned anywhere on the layer 300. In some embodiments, the first region 302' may be positioned at some distance from the second region 302". In some embodiments, the first region 302' and the second region 302" may be relatively near to each other. The distance between each of the first region 302' and the second region 302" may be configured based upon the entire length of the surface 402, the sizes of each of the first region 302' and the second region 302", the number of any other regions 302 apart from the first and second regions 302', 302", or any other configuration. Additionally, the distance between the first and second regions 302', 302" may be determined based on a center-to-center determination or an edge-to-edge determination. The above configurations are exemplary only and do not limit the scope of the invention.

Additionally, each of the first region 302' and the second region 302" may be configured into a desired shape. In some embodiments, each of the first and second regions 302', 302" may be shaped into a representation of a recognizable object, character, ideogram, numeral, or image. In some embodiments, the first region 302' may be shaped into a representation a first object, character, ideogram, numeral, or image in a sequence, and the second region 302' may be shaped into a representation of a second object, character, ideogram, numeral, or image in the sequence. It is appreciated that any number of regions 302 may be configured to represent any number of items in a sequence.

The regions 302 may be formed into the layer 300 by any suitable means, methods, or process. In some embodiments, the layer 300 may include a base material 304, and each of the regions 302 are topically attached to a surface 306 of the base material. Examples of topical attachment including painting, adhesives, glues, transfers, appliqués, static cling, magnetism, and any other method of topical attachment are included within the scope of the invention.

In some embodiments, the regions 302 may be configured to have a first section configured to diffusively scatter light within the scatter wavelength range as described herein above, and a second section configured to absorb light within the scatter wavelength range. For example, in some embodiments, a perimeter of the regions 302 may be configured to absorb light within the scatter wavelength range and an interior of the regions 302 may be configured to diffusively scatter light within the scatter wavelength range. In other embodiments, an interior section of the regions 302 may be configured to absorb light within the scatter wavelength range, and the section of the regions 302 surrounding the interior section may be configured to diffusively scatter light within the scatter wavelength range.

The layer 300 may be any material and of any form that may be applied and attached to a surface of a structure, either fixedly or temporarily. Examples of such forms include, without limitations, paints, sheets of material such as wallpaper, wall coverings, structural wall features, and any other forms known in the art.

The lighting system 200 may be configured to include a plurality of light sources 202 that are capable of emitting light falling within the scatter wavelength ranges of each of the first surface scatter profile and the second surface scatter profile.

In some embodiments, the light emitting elements of the plurality of light sources 202 may be configured to generate polychromatic light having varying spectral power distributions. In other embodiments, the plurality of light sources 202 may emit light, either monochromatic or polychromatic, that combines to form a combined polychromatic light. In either of these embodiments, the polychromatic light may include within its spectral power distribution light within a wavelength range corresponding to a scatter wavelength range associated with one of the first surface scatter profile and the second surface scatter profile, or both. Furthermore, the polychromatic light may be perceived as a white light by an observer.

In some embodiments, the plurality of light sources 202 may be positioned in an array, the array being positionable adjacent to a ceiling. In such embodiments, the layer 300 may be attached to a surface of a wall such that light emitted by the plurality of light sources 202 is incident upon the layer 300.

When the polychromatic light is incident upon the first region 302' and the second region 302", each of the wavelengths included within the spectral power distribution of the polychromatic light will be either absorbed or reflected, scattered, diffusely reflected, or otherwise redirected by each of the regions. More specifically, when the polychromatic light includes a wavelength within a scatter wavelength range associated with one of the first region 302' or the second region 302", or both, the associated scatter wavelength range will be scattered, while the remainder of the spectral power distribution will be absorbed. Accordingly, the light within the scatter wavelength range will be reflected, scattered, diffusely reflected, or otherwise redirected into the environment and observable. Moreover, where the region 302 that is scattering the light is shaped to represent an object, character, ideogram, numeral, or image, that representation will similarly be observable. Correspondingly, when the spectral power distribution of the polychromatic light does not include light within a scatter wavelength range associated with the first region 302' or the second region 302", the regions 302 will absorb approximately the entire spectral power distribution, no light will be scattered, and the regions will be generally less noticeable.

It is appreciated that in a spectral power distribution, lower levels of light within the scatter wavelength ranges associated with each of the regions 302 may be present, even when not intentionally emitted by the lighting system 200. Accordingly, where the lighting system 200 causes the plurality of lighting devices 202 to emit polychromatic light having a peak within its spectral power distribution within a scatter wavelength range associated with one of the first region 302' or the second region 302', or both, the region 302 with that scatter wavelength range will be generally more apparent, noticeable, and accentuated than when the spectral power distribution does not include such a peak, but does still include a relatively lower level of light within the scatter wavelength range.

In some embodiments, the lighting system 200 may include a controller 204 configured to selectively operate the plurality of light sources 202. Furthermore, the controller 204 may be configured to operate the plurality of light sources 202 so as to selectively emit light having a wavelength within the scatter wavelength range of one of the first region 302' or the second region 302", or both. Furthermore, the controller 204 may be configured to operate the plurality of light sources 202 to emit a first polychromatic light including within its spectral power distribution a wavelength within a wavelength range associated with the first region 302', and a second polychromatic light including within its spectral power distribution a wavelength within a wavelength range associated with the second region 302". In this way, the controller 204 may selectively make more prominent to an observer the first region 302', the second region 302", or both, by causing the plurality of light sources 202 to emit a polychromatic light to include a wavelength within the respective scatter wavelength ranges.

In some embodiments, the lighting system 200 may further include a memory 206 in electronic communication with the controller 204. The memory 206 may contain an electronic file that is accessible and readable by the controller 204. The electronic file may include one or more instructions that may be read by the controller 204 that may then cause the controller 204 to operate the plurality of light sources 202 in accordance with the instructions. The instructions may include commands to operate one or more of the plurality of light sources 202 to emit polychromatic light such that the spectral power distribution of the polychromatic light includes or excludes light within a wavelength range associated with a scatter wavelength range of one or both of the first region 302' and the second region 302". Moreover, the instructions may provide a sequence of commands to thusly operate one or more of the plurality of light sources 202 so as to accentuate and make more noticeable the sequence represented in the first and second regions 302', 302". For example, the instructions may include a sequence of wavelengths to be emitted including a first wavelength and a second wavelength. The controller 204 may then determine a first polychromatic light comprising a plurality of wavelengths to be emitted by the plurality of light sources 302 including the first wavelength and excluding the second wavelength. The controller 204 may then operate the plurality of light sources 302 to emit the first polychromatic light. The controller 204 may then determine a second polychromatic light comprising a plurality of wavelengths including the second wavelength and excluding the first wavelength. The controller 204 may then operate the plurality of light sources 302 to emit the second polychromatic light. It is appreciated that the instructions may contain any number of wavelengths in a sequence, and a corresponding number of polychromatic lights including one or more of the wavelengths in the sequence may be determined by the controller 204.

In some embodiments, where one or both of the regions 302 are shaped to represent an object, character, ideogram, numeral, or image, when the polychromatic light includes light within the scatter wavelength range of that region 302, the represented object, character, ideogram, numeral, or image will become highlighted, more apparent, noticeable, and accentuated. As a result, an observer will be more likely to observe and recognize the object, character, ideogram, numeral, or image when the polychromatic light includes light within the scatter wavelength range. Moreover, where the regions 302 include sequential representations, the sequence of those images may similarly be observable.

Figure 2:
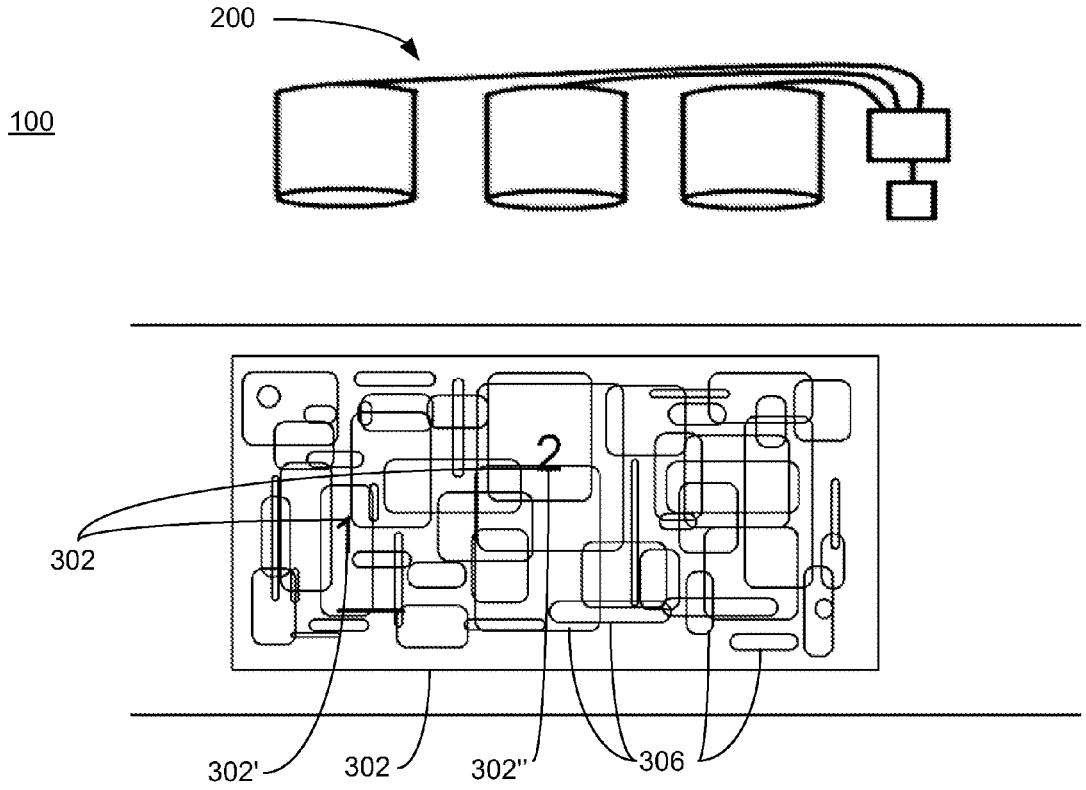
FIG. 2 is a side elevation view of an alternative embodiment of the invention.

For example, referring now to FIG. 2, the first region 302' may be configured into the shape of a numeral, for example, the number 1. Similarly, the second region 302" may be configured into the shape of another numeral, such as the sequential number 2. When the polychromatic light includes within its spectral power distribution a wavelength within the scatter wavelength range associated with the first region 301', the first region 301' will be more prominent to an observer. Accordingly, the number 1 will be more prominent to an observer. Furthermore, if the polychromatic light also includes light within its spectral power distribution a wavelength within the scatter wavelength range associated with the second region 302", the second region 302" will similarly be more prominent, and an observer may more readily see the number 2. The polychromatic light may include both wavelengths associated with the scatter wavelength ranges of the respective regions 302 simultaneously, or it may include them successive or otherwise sequential polychromatic lights, requiring the polychromatic light to vary with time. In this way, any type of sequence, be it a sequence of numbers, letters to form a word, or sequences of images to simulate motion, may be made more prominent across the layer 300.

Furthermore, it is appreciated that the regions 302 may be positioned such that the sequence may be oriented to proceed in any direction across the layer 300. For example, the regions 302 may be positioned such that the sequence progresses laterally, vertically, or in any other geometric configuration, such as a sinusoidal wave, stair-step, a circle, and any other orientation. This list is exemplary only and does not limit the scope of the invention.

In some embodiments, the layer 300 may further include non-accentuated regions 306 positioned on the layer 300 generally surrounding the regions 302. The non-accentuated regions 306 may be configured to facilitate the making more prominent and noticeable the regions 302 when the associated scatter light wavelength is incident thereupon. Moreover, the non-accentuated regions 306 may be configured to make the regions 302 generally less prominent or noticeable when the associated scatter light wavelength is not present. The non-accentuated regions 306 may be generally amorphous, random, pseudo-random, or otherwise not recognizable by an observer to be recognizable as an object, character, ideogram, numeral, or image.

Figure 3:
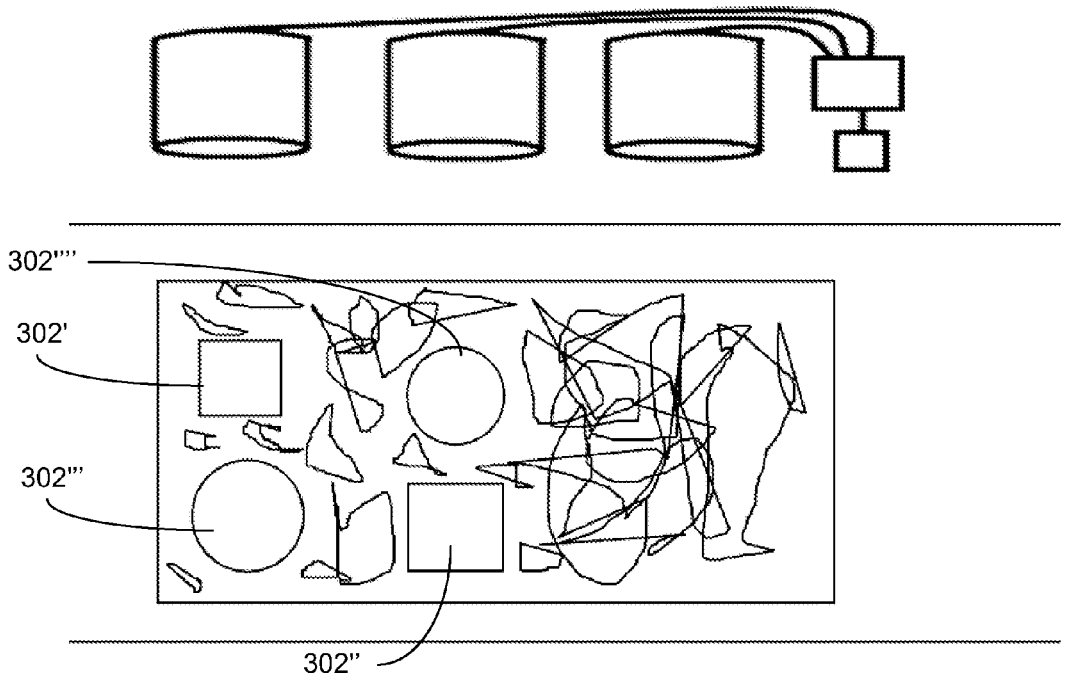
FIG. 3 is a side elevation view of an alternative embodiment of the invention.

Referring now to FIG. 3, another embodiment of the present invention is depicted. In this embodiment, the layer 300 includes a plurality of regions 302, namely a first region 302', a second region 302" and third region 302'", and a fourth region 302"". Similar to the regions described above, the regions 302', 302", 302'", 302"" of FIG. 3 may each have an associated surface scatter profile configured to reflect, scatter, diffusively reflect, or otherwise redirect light incident thereupon that is within a scatter wavelength range or is a scatter wavelength. All light having a wavelength outside the scatter wavelength range or that is different from the scatter wavelength are absorbed.

The third region 302'" may be generally adjacent the first region 302', and the fourth region 302"" may be generally adjacent the second region 302". Additionally, the third region 302'" may have a surface scatter profile that is configured to scatter light within a scatter wavelength range that is about the same as a scatter wavelength range of the first region 302', or it may be different from the scatter wavelength range of the first region 302'. Similarly, the fourth region 302"" may have a surface scatter profile that is configured to scatter light within a scatter wavelength range that is about the same as a scatter wavelength range of the second region 302", or it may be different from the scatter wavelength range of the second region 302". Where the first and third regions 302', 302'" have scatter wavelength ranges that are about the same, when light within that range is present, due to their close proximity, both the first region 302' and the third region 302'" will scatter the light as described above and become accentuated or otherwise more prominent. Where the first and third regions 302', 302'" have scatter wavelength ranges that are different, one or both of the first and third regions 302', 302'" may be made more prominent by a polychromatic light containing a wavelength within the scatter wavelength range of one or both of the first and third regions 302', 302'", i.e. one polychromatic light may include a wavelength within the scatter wavelength range of one of the first and third regions 302', 302'", and a second polychromatic light may include two wavelengths, one within the scatter wavelength range of the first region 302', and the other within the scatter wavelength range of the third region 302'". Accordingly, the first and third regions 302', 302'" may be selectively accentuated. The same may be accomplished with the second and fourth regions 302", 302"".

Figure 4:
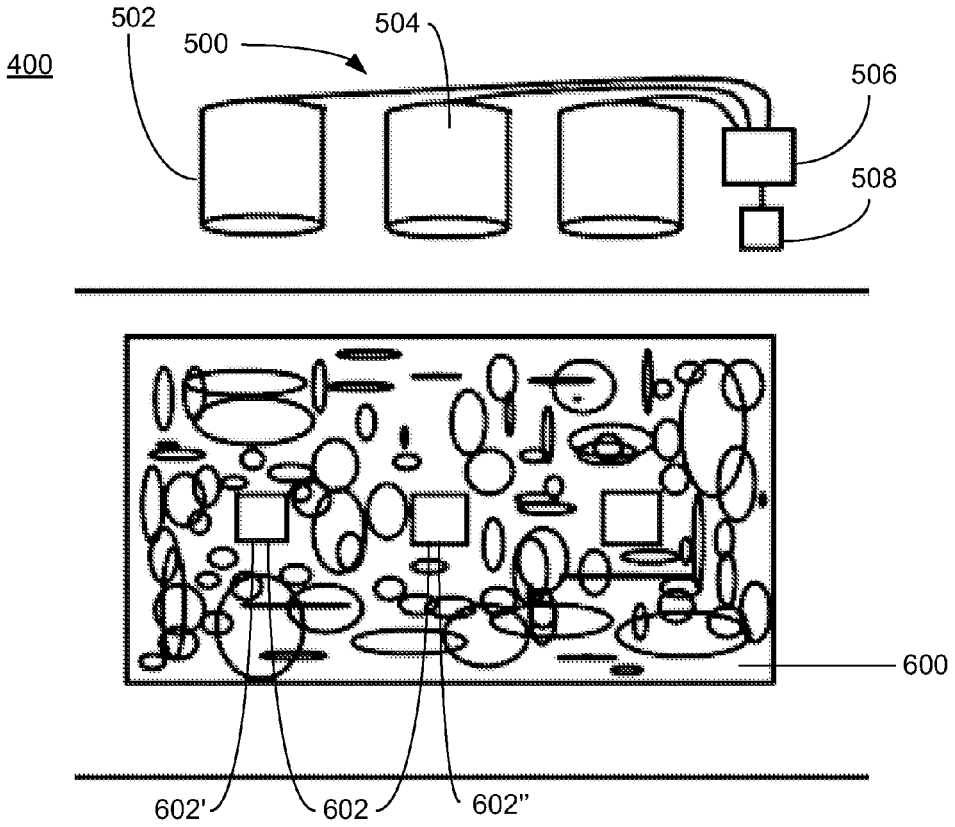
FIG. 4 is a side elevation view of the lighting system and surface of FIG. 1.

Referring now to FIG. 4, an additional embodiment of present invention is depicted. The present embodiment may include a system 400 comprising a lighting system 500 and a layer 600, substantially as described for the embodiment depicted in FIGS. 1-4. However, in the present, the layer 600 includes regions 602, namely a first region 602' and a second region 602", which are configured to have approximately identical surface scatter profiles that are configured to scatter light within a scatter wavelength range. Additionally, the first region 602' and the second region 602" may be positioned on the layer 600 so as to be spaced apart.

Still referring to FIG. 4, the lighting system 500 may include a first light source 502 and a second light source 504. The first light source 502 may be positioned such that light emitted by the first light source 502 is incident upon the first region 602' but is not incident upon the second region 602". Similarly, the second light source 504 may be positioned such that light emitted thereby is incident upon the second region 602" but not upon the first region 602'. The lighting system 500 may further include a controller 506 configured to selectively operate each of the first light source 502 and the second light source 504 independently of each other. Furthermore the controller 506 may be configured to operate each of the first and second light sources 502, 504 to emit polychromatic light. Yet further, the controller 506 may be configured to operate each of the first and second light sources 502, 504 such that, in a first instance, the first light source 502 emits a polychromatic light having a spectral power distribution including a wavelength within the scatter wavelength range of the first and second regions 602', 602", and the second light source 504 emits a polychromatic light having a spectral power distribution not including a wavelength within the scatter wavelength range of the first and second regions 602', 602". Because light emitted by the first light source 502 is incident upon the first region 602' and not the second region 602", only the first region 602' scatters the lighting within the scatter wavelength range and, hence, is made more prominent or noticeable.

Furthermore, the controller 506 may be configured to operate each of the first and second light sources 502, 504 such that, in a second instance, the first light source 502 emits a polychromatic light having a spectral power distribution not including a wavelength within the scatter wavelength range of the first and second regions 602', 602", and the second light source 504 emits a polychromatic light having a spectral power distribution including a wavelength within the scatter wavelength range of the first and second regions 602', 602". Because light emitted by the second light source 502 is incident upon the second region 602" and not the first region 602', only the second region 602" scatters the lighting within the scatter wavelength range and, hence, is made more prominent or noticeable.

The lighting system 500 may further include a memory 508 substantially as described above. The memory 508 may include instructions that are readable by the controller 506 that may include a sequence of wavelengths that may be used by the controller 506 to generate a sequence of polychromatic lights including one or more of the sequence of wavelengths that may be scattered by one or more of the regions 602.

Figure 5:
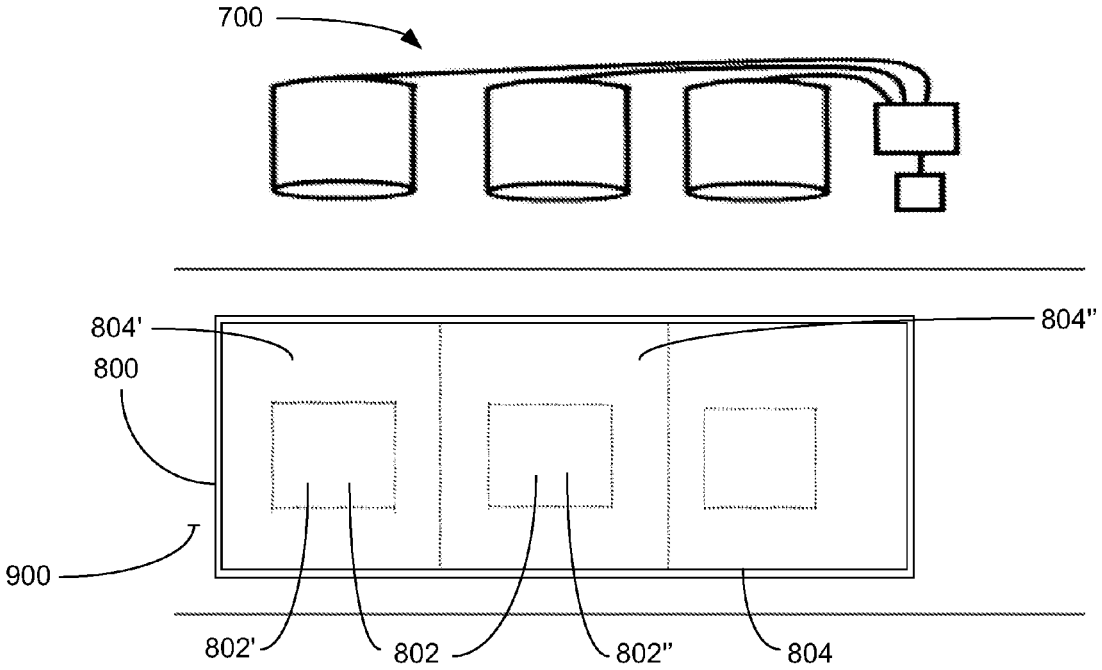
FIG. 5 is a side sectional view of a surface according to an alternative embodiment of the invention.

Referring now to FIG. 5, another embodiment of the present invention is now depicted. Some embodiments may include a lighting system 700 and a layer 800. The lighting system 700 may be substantially as described above, including a plurality of light sources 702 capable of emitting polychromatic light and a controller 704 coupled to each of the plurality of light sources 702 so as to control their emission.

The layer 800 may include one or more appliqués 802 attached to a surface 900. The appliqués 802 may be functionally similar to the regions 302, 602, described hereinabove, namely, have a scatter profile configured to diffusively scatter light within a scatter wavelength range and absorb light outside the scatter wavelength range. Similar to above, the appliqués 802 may be configured to wave scatter wavelength ranges that are approximately the same or are different. In some embodiments, the layer 800 may include a first appliqué 802' and a second appliqué 802". Additionally, the surface 900 may be configured to absorb light within the scatter wavelength range.

The appliqués 802 may be configured into a shape as described hereinabove for the regions 302, 602. Additionally, the appliqués 802 may be configured into shapes corresponding to a sequence or series. Furthermore, the appliqués 802 may be positioned about the layer 800 in any geometric configuration, as described hereinabove.

The layer 800 may further include a cover layer 804. The cover layer 804 may be positioned so as to generally cover the surface 900 and the appliqués 802. Where the cover layer 804 is so positioned, in order for any light to be incident upon the appliqués 802, it must traverse through the cover layer 804. Accordingly, the cover layer 804 may be configured to be transparent, translucent, or otherwise permit the traversal of light therethrough. In some embodiments, the cover layer 804 may be transparent to the entire spectrum of light. In some embodiments, the cover layer 804 may be transparent to only a portion of the spectrum of light, such as, for example, the visible spectrum, the infrared spectrum, and the ultraviolet spectrum. Furthermore, in some embodiments, the cover layer 804 may be configured to be transparent to a portion of the visible spectrum. In some embodiments, the cover layer 804 may be transparent to one or more portions of the visible spectrum corresponding to one or more scatter wavelength spectrums associated with the appliqués 802. For example, if the first appliqué 802' and the second appliqué 802" have scatter wavelength spectrums that are approximately equal, the cover layer 804 may be transparent to light within the scatter wavelength spectrum. As another example, where the first appliqué 802' has a scatter wavelength range that is different from that of the second appliqué 802", the cover layer 804 may be transparent to light within the scatter wavelength ranges of each of the first appliqué 802' and the second appliqué 802".

Moreover, in some embodiments, the cover layer 804 may include a first section 804' associated with and positioned so as to generally cover the first appliqué 802' and a second section 804" associated with and positioned so as to generally cover the second appliqué 802". The first section 804' may be configured to be generally transparent to light within a wavelength range corresponding to the scatter wavelength range of the first appliqué 802', and the second section 804" may be configured to be generally transparent to light within a wavelength range corresponding to the scatter wavelength range of the second appliqué 802".

Figure 6:
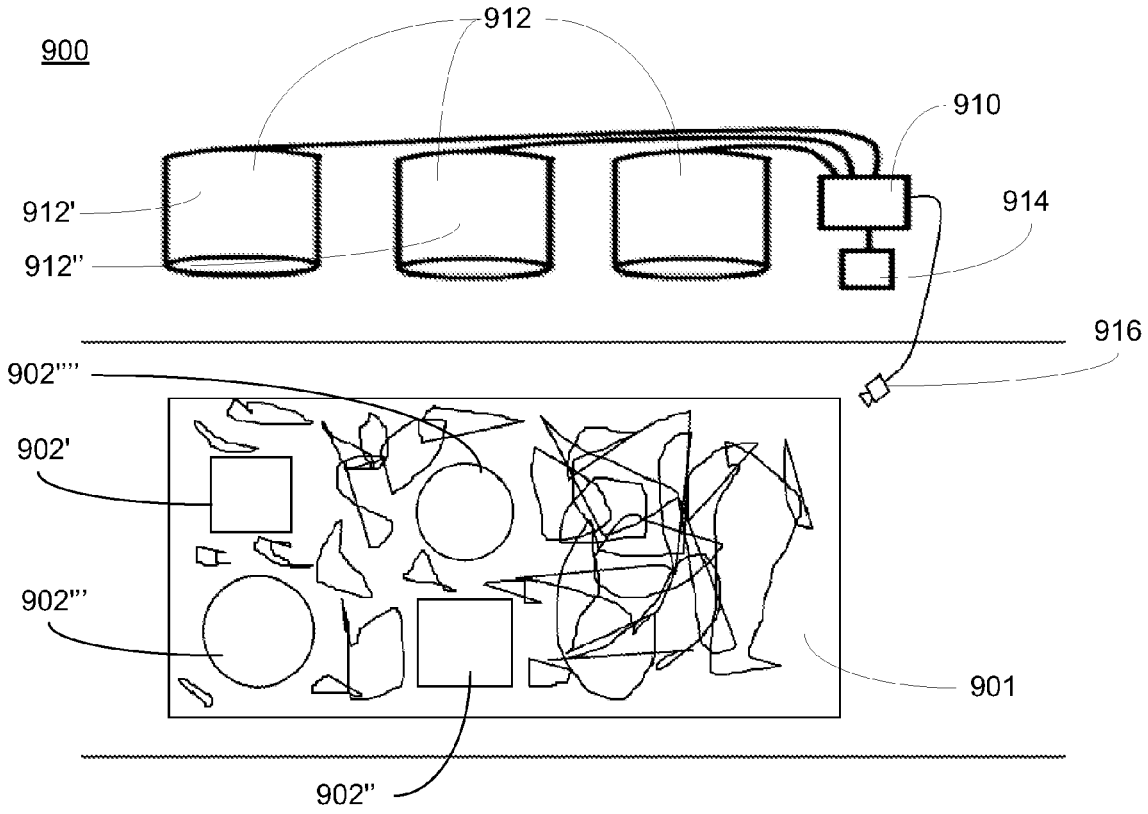
FIG. 6 is a side elevation view of an alternative embodiment of the invention.

Referring now to FIG. 6, an alternative embodiment of the invention will now be discussed. The present embodiment may comprise a lighting system 900 that may comprise similar elements to the lighting systems as described hereinabove. More specifically, the lighting system 900 may comprise a computerized device 910, a plurality of light sources 912, and a memory 914. In the present embodiment, the plurality of light sources 912 may be positioned so as to emit light that is incident upon a target surface 901. The target surface 901 may be any surface that contains a plurality of regions 902 configured to reflect light within a wavelength range so as to be perceptible by an observer as a pattern. Additionally, the plurality of light sources 912 may include a first light source 912' positioned at a first location and a second light source 912" positioned at a second location. Light emitted by the first light source 912' may be incident upon each of a first and third region 902', 902'" of the target surface 901, and not incident upon each of a second and fourth regions 902", 902"" of the target surface 901. Similarly, light emitted by the second light source 912" may be incident upon each of the second and fourth regions 902", 902"" of the target surface 901, and not incident upon the first and third regions 902', 902'" of the target surface 901.

In the present embodiment, the lighting system 900 may further comprise a color capture device 916. The color capture device 916 may be operatively coupled to the computerized device 910 and configured to measure light reflected by a target surface 901. More specifically, the color capture device 916 may be positioned such that light reflected by the target surface 901 may be incident upon a sensing device of the color capture device 916. The color capture device 916 may be configured to enable the determination of the wavelength of light reflected by the target surface 901. Additionally, the color capture device 916 may be configured to enable the determination of a location within the target surface 901 from which the light is reflected. In some embodiments, the color capture device 916 may be configured to capture light information so as to digitally recreate an image of the light reflected by the target surface 901, including at least the wavelength of light reflected thereby and the location associated with the reflection of certain wavelengths. The information measured by the color capture device 916 may be sent to the computerized device 910. Additionally, in some embodiments, the color capture device 916 may be an integral component of one of the computerized device 910 and a light source of the plurality of light sources 912. Additional information regarding the color capture device 916 may be found in U.S. patent application Ser. Nos. 13/792,354 and 13/775,936, each of which are incorporated by reference hereinabove.

The color capture device 916 is illustrated in FIG. 6 as being a single color capture device, but those skilled in the art will appreciate that the color capture device of the lighting system 900 according to embodiments of the present invention may be provided by a plurality of color capture devices. More specifically, in some embodiments, the color capture device 916 may be provided by a plurality of color capture devices each associated, and each of the respective plurality of color capture devices may be associated with a respective light source 912.

Additionally, in the present embodiment, the computerized device 910 may be configured to operate the plurality of lighting devices 912 to emit an analysis light. The analysis light may be configured so as to be reflected at least partially in the direction of the color capture device 916. Moreover, the analysis light may have a spectral power distribution that enables the reflection of light across the visible spectrum by the target surface 901. Accordingly, in such embodiments, the analysis light may be considered to be a polychromatic light. In some embodiments, the analysis light may be characterized by a color rendering index of 90 or above. In other embodiments, the analysis light may be characterized by a color rendering index of 95 or above. In yet other embodiments, the analysis light may be characterized by a color rendering index of 99 or above.

Additionally, the computerized device 910 may include a pattern recognition algorithm. The pattern recognition algorithm may be configured to identify a region of the target surface 901 that reflects one or more wavelength ranges of light. Moreover, the regions that reflect the wavelength ranges of light may be identifiable by the pattern recognition algorithm combining to form a pattern. The type of pattern identified may be any type of pattern or sequence as discussed hereinabove.

The lighting system 900 may include a color matching engine. The color matching engine may be configured to determine a dominant wavelength of a wavelength range. The dominant wavelength may be understood as a color associated with a wavelength range. A dominant wavelength may be a wavelength of light having a peak intensity within a wavelength range. Additional information regarding the color matching engine, its operation, and dominant wavelengths may be found in U.S. patent application Ser. Nos. 13/792,354 and 13/775,936, each of which are incorporated by reference hereinabove. In some embodiments, the color matching engine may be incorporated with the computerized device 910.

Figure 7:
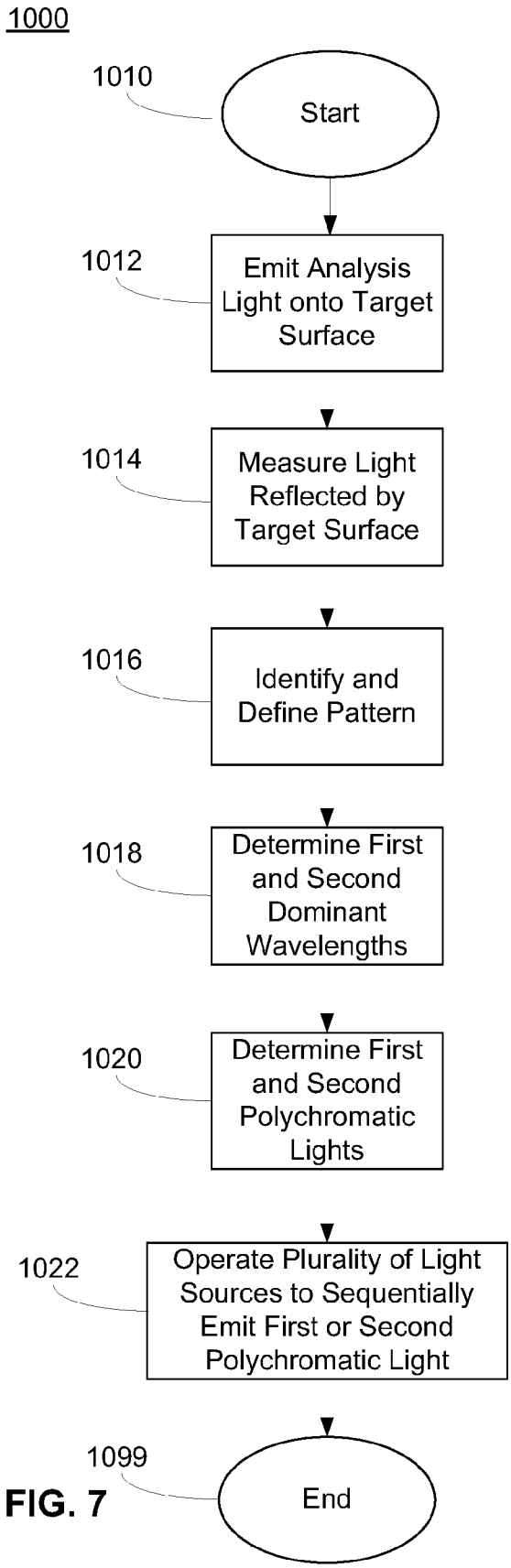
FIG. 7 is a flowchart illustrating a method according to an embodiment of the invention.

Referring now to FIG. 7, a method 1000 according to an embodiment of the invention is presented. It is contemplated that the following method may be performed by any embodiment of the invention described hereinabove, notably the embodiment depicted in FIG. 6. Furthermore, any additional functionality described with respect to the method 1000 may be incorporated into any of the embodiments recited hereinabove.

Beginning at Block 1010, the method 1000 may continue at Block 1012 where a computerized device may operate the lighting system to emit an analysis light onto a target surface. At Block 1014, a color capture device may measure the light reflected by the target surface. The light that is reflected by the target surface may be the analysis light emitted by the plurality of light sources. At Block 1016, the measurements of the color capture device may be processed by the computerized device so as to identify a region of the target surface that reflects two or more wavelength ranges of light. The identified regions may be identified by the computerized device so as to define a pattern, the pattern including a first region having a first surface scatter profile associated with a first wavelength range and a second region having a second surface scatter profile with a second wavelength range. For example, referring to FIG. 6, the target surface 901 may include a plurality of regions 902 comprising a first region 902' and a second region 902" wherein the first region 902' has a first surface scatter profile associated with a first wavelength range and the second region 902" has a second surface scatter profile associated with a second wavelength range. It is contemplated and included within the invention that the pattern identified may include any number of regions associated therewith each having a surface scatter profile with a wavelength range. In some embodiments, one or more of the wavelength ranges may overlap and/or be coextensive.

Continuing at Block 1018, a color matching engine may perform a matching operation that operates to determine a first dominant wavelength of the first wavelength range and a second dominant wavelength of the second wavelength range. Additionally, at Block 1020, the color matching engine may determine a first polychromatic light including the first dominant wavelength but excluding the second dominant wavelength. Moreover, the color matching engine may also determine a second polychromatic light including the second dominant wavelength but excluding the first dominant wavelength. Accordingly, where the plurality of luminaires is operated to emit the first polychromatic light, the first dominant wavelength will be reflected by the first region of the pattern, operating to cause the first region to be more apparent to an observer thereof. Furthermore, the exclusion of the second dominant wavelength will operate to make the second region less apparent to an observer thereof relative to the first region. Conversely, where the plurality of luminaires are operation to emit the second polychromatic light, the second dominant wavelength will be reflected by the second region of the pattern, operating to cause the second region to be more apparent to an observer thereof, while the exclusion of the first dominant wavelength will operate to make the first region less apparent to an observer thereof relative to the second region.

At Block 1022, the computerized device may operate the plurality of light sources so as to emit a combined light being sequentially each of the first polychromatic light and the second polychromatic light. More specifically, the computerized device may operate the plurality of light sources so as to first accentuate one of the first and second regions, and then subsequently accentuate the other. In some embodiments, the computerized device may be configured to emit the first polychromatic light for a first duration and the second polychromatic light for a second duration. The first and second durations may be of approximately equal length, or may be of differing lengths. Moreover, in some embodiments, the first and second durations may be of a length that, when a transition is made therebetween, the transition operates to simulate motion between the first and second regions. Such simulated motion may be more apparent with the inclusion of additional regions. Further, the transition between the first and second polychromatic lights may be instantaneous, may overlap, or may have a period where neither of the first or second polychromatic lights is emitted. In such a period, no light may be emitted, or light may be emitted that excludes each of the first and second dominant wavelengths. The method 1000 may then end at Block 1099.

Figure 8:
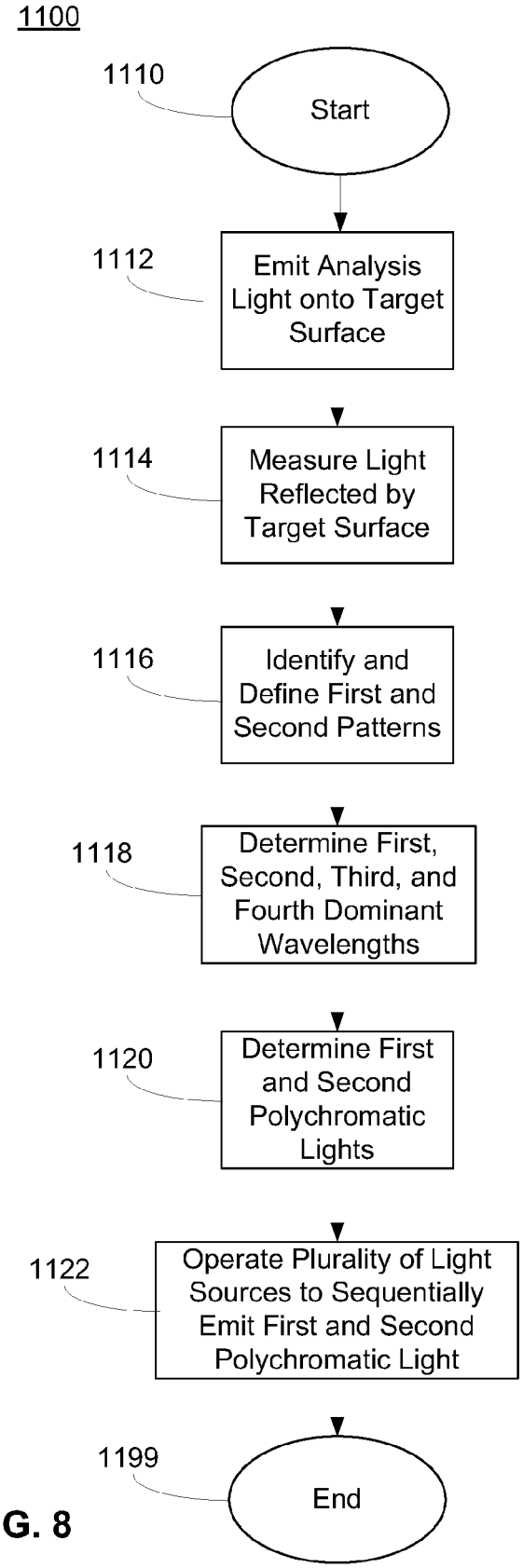
FIG. 8 is a flowchart illustrating a method according to an embodiment of the invention.

Referring now to FIG. 8, a method 1100 according to another embodiment of the present invention is presented. Elements of the method 1100 may be similar to the method 1000 of FIG. 7. Beginning at Block 1110, the method 1100 may continue at Block 1112 where a computerized device may operate the lighting system to emit an analysis light onto a target surface. At Block 1114, the light reflected by the target surface may be measured. This may be accomplished, for example, using a color capture device. The light that gets reflected by the target surface may be the analysis light emitted by the plurality of light sources. At Block 1116, the measurements of the color capture device may be processed by the computerized device so as to identify a region of the target surface that reflects two or more wavelength ranges of light. The identified regions may be identified by the computerized device so as to define a first defined pattern and a second defined pattern.

The first defined pattern may include a first region having a first surface scatter profile associated with a first wavelength range and a second region having a second surface scatter profile with a second wavelength range. The second defined pattern may include a third region having a third surface scatter profile associated with a third wavelength range and a fourth region having a fourth surface scatter profile with a fourth wavelength range. For example, referring to FIG. 6, the target surface 901 may include a plurality of regions 902 comprising a first region 902' and a second region 902" wherein the first region 902' has a first surface scatter profile associated with a first wavelength range and the second region 902" has a second surface scatter profile associated with a second wavelength range. The plurality of regions 902 may further comprise a third region 902'" and a fourth region 904"" wherein the third region 902'" has a third surface scatter profile associated with a third wavelength range and the fourth region 902"" has a fourth surface scatter profile associated with a fourth wavelength range.

Continuing at Block 1118, a matching operation may be performed that operates to determine a first dominant wavelength of the first wavelength range, a second dominant wavelength of the second wavelength range, a third dominant wavelength of the third wavelength range, and a fourth dominant wavelength of the fourth wavelength range. The matching operation may, for example, be performed using a color matching engine. Additionally, at Block 1120, the color matching engine may determine a first polychromatic light including the first and third dominant wavelengths and excluding the second and fourth dominant wavelengths. Furthermore, the color matching engine may determine a second polychromatic light including the second and fourth dominant wavelengths and excluding the first and third dominant wavelengths. Accordingly, where the plurality of luminaires are operated to emit the first polychromatic light, the first and third dominant wavelengths will be reflected by the first and third regions of the first and second defined patterns, operating to cause the first and third regions to be more apparent to an observer thereof simultaneously. Furthermore, the exclusion of the second and fourth dominant wavelengths will operate to make the second and fourth regions less apparent to an observer thereof relative to the first and third regions, respectively. Conversely, where the plurality of luminaires are operational to emit the second polychromatic light, the second and fourth dominant wavelengths will be reflected by the second and fourth regions of the first and second defined patterns, respectively, operating to cause the second and fourth regions to be more apparent to an observer thereof simultaneously, while the exclusion of the first and third dominant wavelengths will operate to make the first and third regions less apparent to an observer thereof relative to the second and fourth regions, respectively.

At Block 1122, the plurality of light sources may be operated so as to emit a combined light being sequentially each of the first polychromatic light and the second polychromatic light. The plurality of light sources may, for example, be operated by the computerized device. More specifically, the computerized device may operate the plurality of light sources so as to first accentuate one of the pairs of the first and third regions and the second and fourth regions, and then subsequently accentuate the other pair. Similar to Block 1022, the computerized device may operate the plurality of luminaires to emit the first polychromatic light for a first duration and the second polychromatic light for a second duration. The method 1100 may then end at Block 1199.

Figure 9:
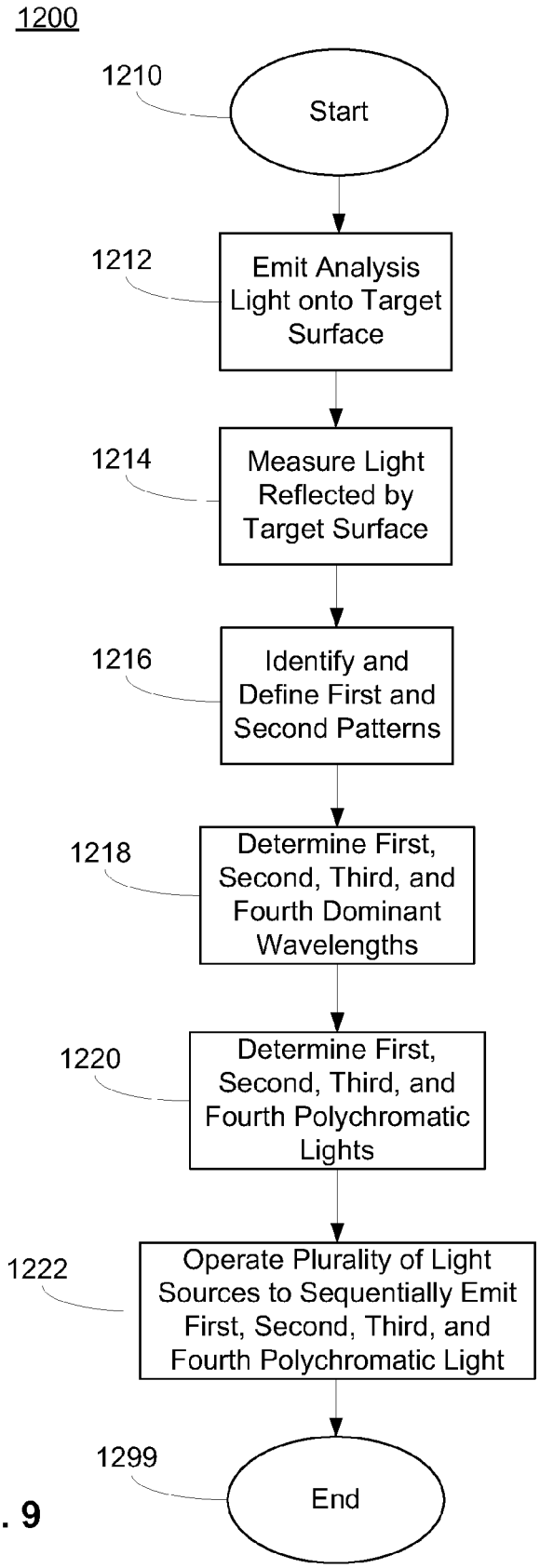
FIG. 9 is a flowchart illustrating a method according to an embodiment of the invention.

Referring now to FIG. 9, a method 1200 according to another embodiment of the present invention is presented. Elements of the method 1200 may be similar to the methods 1000 and 1100 of FIGS. 7 and 8. Beginning at Block 1210, the method 1200 may continue at Block 1212 where the lighting system may be operated to emit an analysis light onto a target surface. Operation of the lighting system may be carried out using a computerized device, for example. At Block 1214, a color capture device may measure the light reflected by the target surface. The light that gets reflected by the target surface may be the analysis light emitted by the plurality of light sources. At Block 1216, the measurements of the color capture device may be processed by the computerized device so as to identify a region of the target surface that reflects two or more wavelength ranges of light. The identified regions may be identified by the computerized device so as to define a first defined pattern and a second defined pattern. The first defined pattern may include a first region having a first surface scatter profile associated with a first wavelength range and a second region having a second surface scatter profile with a second wavelength range. The second defined pattern may include a third region having a third surface scatter profile associated with a third wavelength range and a fourth region having a fourth surface scatter profile with a fourth wavelength range.

Additionally, the plurality of luminaires may be operated so as to sequentially emit a combined light being the first polychromatic light for a first duration, being the second polychromatic light for a second duration, being the third polychromatic light for a third duration, and being the fourth polychromatic light for a fourth duration. Similar to the durations recited hereinabove, the first, second, third, and fourth durations may be of any length, may overlap or have gaps therebetween, and may be selected so as to simulation motion in a transition between any of the first, second, third, and fourth regions.

Continuing at Block 1218, a matching operation may be performed to determine a first dominant wavelength of the first wavelength range, a second dominant wavelength of the second wavelength range, a third dominant wavelength of the third wavelength range, and a fourth dominant wavelength of the fourth wavelength range. The matching operation may, for example, be performed using a color matching engine. Additionally, at Block 1220, the color matching engine may determine a first polychromatic light including the first dominant wavelength and excluding each of the second, third, and fourth dominant wavelengths, a second polychromatic light including the second dominant wavelength and excluding each of the first, third, and fourth dominant wavelengths, determine a third polychromatic light including the third dominant wavelength and excluding each of the first, second, and fourth dominant wavelengths, and determine a fourth polychromatic light including the fourth dominant wavelength and excluding each of the first, second, and third dominant wavelengths.

At Block 1222, the plurality of light sources may be operated so as to sequentially emit a combined light being one of the first polychromatic light, the second polychromatic light, the third polychromatic light, and the fourth polychromatic light. The plurality of light sources may, for example, be operated by the computerized device. More specifically, the computerized device may operate the plurality of light sources so as to sequentially accentuate each of the first, second, third, and fourth regions in any order. In some embodiments, the computerized device may operate the plurality of light sources so as to first accentuate the first regions, second accentuate the second region, third accentuate the third region, and fourth accentuate the fourth region. In this way, the computerized device may first accentuate the regions of the first pattern sequentially, and then accentuate the regions of the second defined pattern sequentially. It is contemplated and included within the scope of the invention that each of the first and second defined patterns may comprise any number of regions to be accentuated, and that any number of patterns may be identified and defined and have its regions sequentially accentuated. The method 1200 may then end at Block 1299.

Figure 10:
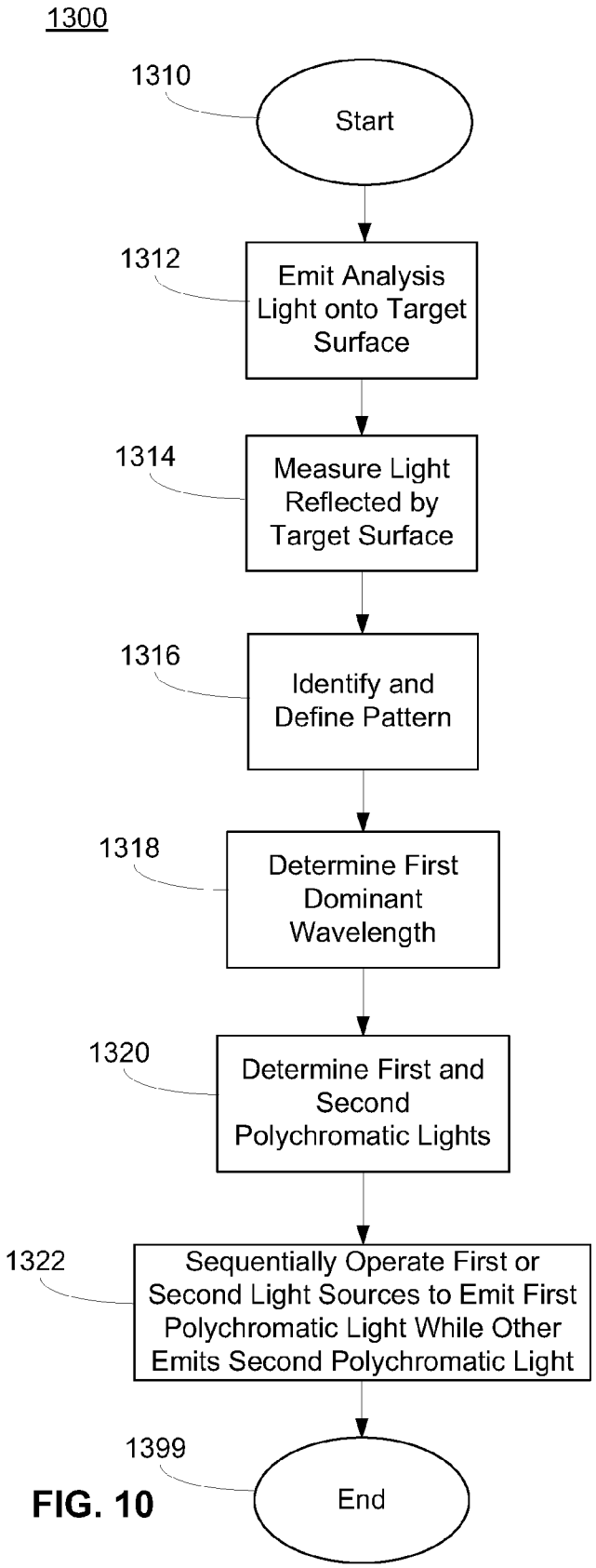
FIG. 10 is a flowchart illustrating a method according to an embodiment of the invention.

Referring now to FIG. 10, a method 1300 according to an embodiment of the invention is presented. Beginning at Block 1310, the method 1300 may continue at Block 1312 where the lighting system may be operated to emit an analysis light onto a target surface. The lighting system may, for example, be operated by a computerized device. At Block 1314, the light reflected by the target surface may be measured. The light that is reflected by the target surface may, for example, be measured using a color capture device. The light that gets reflected by the target surface may be the analysis light emitted by the plurality of light sources. At Block 1316, the measurements of the color capture device may be processed by, for example, a computerized device so as to identify a region of the target surface that reflects light within a first wavelength range of light using a pattern recognition algorithm. The identified regions may be identified by the computerized device so as to define a pattern, the pattern including first and second regions having a first surface scatter profile associated with a first wavelength range.

Continuing at Block 1318, a matching operation may be performed to determine a first dominant wavelength of the first wavelength range. The matching operation may be performed using a color matching engine. Additionally, at Block 1320, the color matching engine may determine a first polychromatic light including the first dominant wavelength and a second polychromatic light excluding the first dominant wavelength. Accordingly, where the plurality of luminaires are operated to emit the first polychromatic light, the first dominant wavelength will be reflected by the first and second regions of the pattern, operating to cause the first and second regions to be more apparent to an observer thereof. Where the plurality of luminaires are operation to emit the second polychromatic light, the exclusion of the first dominant wavelength will operate to make the first and second regions less apparent to an observer thereof relative to where the plurality of luminaires emit the first polychromatic light.

At Block 1322, the first and second light sources may be sequentially operated. The sequential operation of the first and second light sources may, for example, be carried out using the computerized device. More specifically, one of a first light source and a second light source of the plurality of light sources may be sequentially operated so as to emit the first polychromatic light and the other to emit the second polychromatic light simultaneously. More specifically, referring illustratively to FIG. 6, the computerized device 910 may operate the first light source 912' to emit the first polychromatic light while operating the second light source 912" to emit the second polychromatic light. While in this state of operation, the first region 902' may reflect the first dominant wavelength that is included with the first polychromatic light, as light emitted by the first light source 912' is incident upon the first region 902' and reflectable thereby. However, as light from the first light source 912' is not incident upon the second region 902", and the second light source 912", light from which is incident upon and reflectable by the second region 902", does not include the first dominant wavelength, the second region 902" does not reflect the first dominant wavelength, as it is not incident thereupon. Accordingly, the first region 902' may be more apparent to an observer thereof relative to the second region 902".

Subsequently, the first light source 912' may be operated to emit the second polychromatic light and the second light source 912" may be operated to emit the first polychromatic light source. While in this state of operation, the second region 902" may reflect the first dominant wavelength that is included with the first polychromatic light, as light emitted by the second light source 912" is incident upon the second region 902" and reflectable thereby. However, as light from the second light source 912" is not incident upon the first region 902', and the first light source 912', light from which is incident upon and reflectable by the first region 902', does not include the first dominant wavelength, the first region 902' does not reflect the first dominant wavelength, as it is not incident thereupon. Accordingly, the second region 902" may be more apparent to an observer thereof relative to the first region 902'. It is contemplated that this sequence may occur in any order, and may be extended to a pattern having any number of regions. In some embodiments, two or more regions of a pattern may be accentuated at a time, requiring the simultaneous emission of a polychromatic light including the first dominant wavelength by each light source from which emitted light is incident upon the region to be accentuated.

In some embodiments, the first light source may be operated to emit the first polychromatic light and the second light source may be operated to emit the second polychromatic light for a first duration. Operation of the first and second light sources may be carried out using the computerized device. Furthermore, the computerized device may be configured to operate the first light source to emit the second polychromatic light and the second light source to emit the first polychromatic light for a second duration. The first and second durations may be of approximately equal length, or may be of differing lengths. Moreover, in some embodiments, the first and second durations may be of a length that, when a transition is made therebetween, the transition operates to simulate motion between the first and second regions. Such simulated motion may be more apparent with the inclusion of additional regions. Moreover, the transition may be instantaneous, may overlap, or may have a period where neither of the first or second polychromatic lights is emitted by the first and second light sources. In such a period, no light may be emitted, or light may be emitted that excludes each of the first and second dominant wavelengths. The method 1300 may then end at Block 1399.

Figure 11:
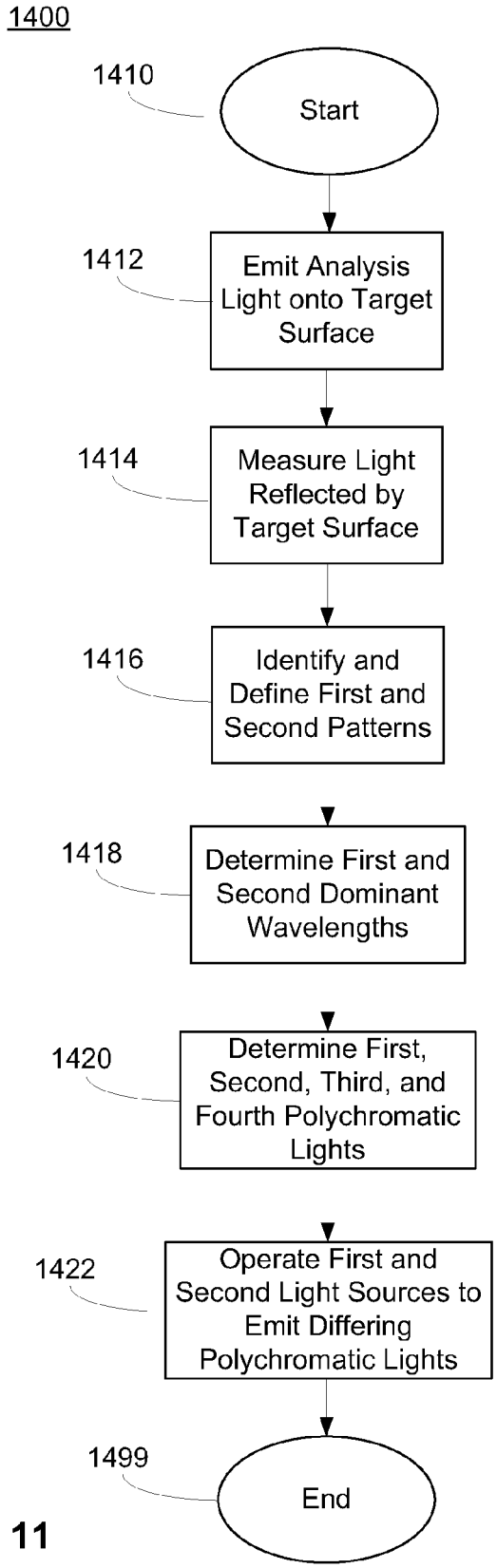
FIG. 11 is a flowchart illustrating a method according to an embodiment of the invention.

Referring now to FIG. 11, a method 1400 according to another embodiment of the present invention is presented. Elements of the method 1400 may be similar to the method 1300 of FIG. 10. Beginning at Block 1410, the method 1400 may continue at Block 1412 where the lighting system may be operated to emit an analysis light onto a target surface. The lighting system may, for example, be operated using a computerized device. At Block 1414, the light reflected by the target surface may be measured. Such a measurement may be performed, for example, using a color capture device. The light that is reflected by the target surface may be the analysis light emitted by the plurality of light sources. At Block 1416, the measurements may be processed by the computerized device so as to identify a region of the target surface that reflects two or more wavelength ranges of light. The identified regions may be identified by the computerized device so as to define a first defined pattern and a second defined pattern.

The first defined pattern may include a first region and a second region having a first surface scatter profile associated with a first wavelength range. The second defined pattern may include a third region and a fourth region having a second surface scatter profile associated with a second wavelength range. For example, referring to FIG. 6, the target surface 901 may include a plurality of regions 902 comprising a first region 902' and a second region 902" wherein the first and second regions 902', 902'" have a first surface scatter profile associated with a first wavelength range and the second and fourth regions 902", 904"" have a second surface scatter profile associated with a second wavelength range.

Continuing at Block 1418, a color matching engine may perform a matching operation that operates to determine a first dominant wavelength of the first wavelength range and a second dominant wavelength of the second wavelength range. Additionally, at Block 1420, a first polychromatic light including the first dominant wavelength may be determined, a second polychromatic light including each of the first dominant wavelength and the second dominant wavelength may be determined, a third polychromatic light including the second dominant wavelength and excluding the first dominant wavelength may be determined, and a fourth polychromatic light excluding each of the first and second dominant wavelengths may be determined. Accordingly, where the plurality of luminaires are operated to emit the first polychromatic light, the first dominant wavelength will be reflected by the first and second regions of the first defined pattern, operating to cause the first and second regions to be more apparent to an observer thereof. Moreover, the exclusion of the second dominant wavelength will operate to make the third and fourth regions of the second defined pattern less apparent to an observer thereof respective to the first and second regions of the first defined pattern. Where the plurality of luminaires are operation to emit the second polychromatic light, the exclusion of the first dominant wavelength will operate to make the first and second regions less apparent to an observer thereof relative to where the plurality of luminaires emit the first polychromatic light.

At Block 1422, one of a first light source and a second light source of the plurality of light sources may be sequentially operated such that one of the first light source and the second light source emits the first polychromatic light while the other emits the fourth polychromatic light simultaneously, one of the first light source and the second light source emits the second polychromatic light while the other emits the fourth polychromatic light simultaneously, and one of the first light source and the second light source emits the third polychromatic light while the other emits the fourth polychromatic light simultaneously. Sequential operation of the first light source and the second light source may be carried out using the computerized device. In this way, only regions of the first and second defined patterns upon which light incident from one of the first and second light sources may be accentuated relative to regions upon which light from the other is incident. More specifically, either one or both of the first and third regions may be accentuated while both of the second and fourth regions are not accentuated, and either one or both of the second and fourth regions are accentuated while both of the first and third regions are not accentuated. The method 1400 may then end at Block 1499.

In an alternative embodiment, the first and second light sources may be operated so as to accentuate each of the first and fourth regions simultaneously and not accentuate either of the second and third regions, and then operate the first and second light sources to accentuate the second and third regions and not accentuate the first and fourth regions. These combinations are exemplary only, and any combination of accentuations are contemplated and included within the scope of the invention.

Figure 12:
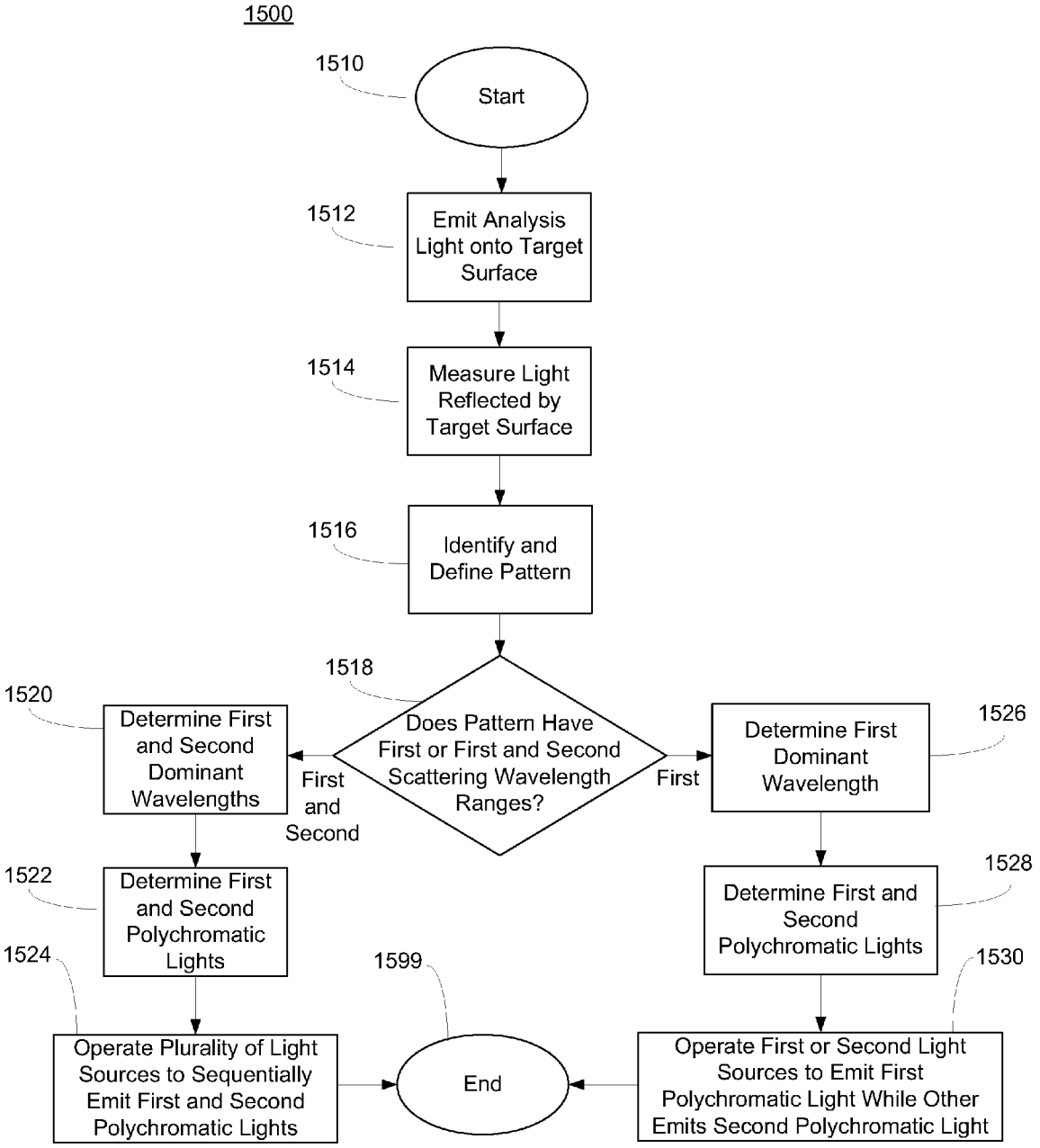
FIG. 12 is a flowchart illustrating a method according to an embodiment of the invention.

Referring now to FIG. 12, a method 1500 according to another embodiment of the present invention is presented. Beginning at Block 1510, the method 1500 may continue at Block 1512 where the lighting system may be operated to emit an analysis light onto a target surface. The lighting system may, for example, be operated by a computer device. At Block 1514, the light reflected by the target surface may be measured. The measurement of the light reflected by the target surface may, for example, be carried out using a color capture device. The light that gets reflected by the target surface may be the analysis light emitted by the plurality of light sources. At Block 1516, the measurements of the may be processed so as to identify a region of the target surface that reflects two or more wavelength ranges of light. The processing of the measurements may, for example, be carried out using the computerized device. The identified regions may be identified by the computerized device so as to define a pattern. At Block 1518, it may determined if the defined pattern comprises first and second regions having a first surface scattering profile with an associated first wavelength range, or a first region having a first surface scatter profile with an associated first wavelength range and a second region having a second surface scatter profile with an associated second wavelength region.

If, at Block 1518, it is determined that the defined pattern comprises a first region having a first surface scatter profile with an associated first wavelength range and a second region having a second surface scatter profile with an associated second wavelength region, then the method 1500 may continue at Block 1520 where a matching operation may be performed to determine a first dominant wavelength of the first wavelength range and a second dominant wavelength of the second wavelength range. This matching operation may, for example, be performed using a color matching engine. At Block 1522 the color matching engine may determine a first polychromatic light including the first dominant wavelength but excluding the second dominant wavelength. Moreover, the color matching engine may also determine a second polychromatic light including the second dominant wavelength but excluding the first dominant wavelength. Accordingly, where the plurality of luminaires is operated to emit the first polychromatic light, the first dominant wavelength will be reflected by the first region of the pattern, operating to cause the first region to be more apparent to an observer thereof. Furthermore, the exclusion of the second dominant wavelength will operate to make the second region less apparent to an observer thereof relative to the first region.

At Block 1524, the plurality of light sources may be operated so as to emit a combined light being sequentially each of the first polychromatic light and the second polychromatic light. The plurality of light sources may, for example, be operated by the computerized device. More specifically, the computerized device may operate the plurality of light sources so as to first accentuate one of the first and second regions, and then subsequently accentuate the other, similar to the operation of Block 1022 of FIG. 7. The method 1500 may then end at 1599.

If, at Block 1518, it is determined that the defined pattern comprises first and second regions having a first surface scattering profile with an associated first wavelength range, then the method 1500 may continue at Block 1526 where a matching operation may be performed to determine a first dominant wavelength of the first wavelength range. The matching operation may, for example, be performed using a color matching engine. Additionally, at Block 1528, the color matching engine may determine a first polychromatic light including the first dominant wavelength and a second polychromatic light excluding the first dominant wavelength. Accordingly, where the plurality of luminaires are operated to emit the first polychromatic light, the first dominant wavelength will be reflected by the first and second regions of the pattern, operating to cause the first and second regions to be more apparent to an observer thereof. Where the plurality of luminaires are operation to emit the second polychromatic light, the exclusion of the first dominant wavelength will operate to make the first and second regions less apparent to an observer thereof relative to where the plurality of luminaires emit the first polychromatic light.

At Block 1530, one of a first light source and a second light source of the plurality of light sources may be sequentially operated so as to emit the first polychromatic light and the other to emit the second polychromatic light simultaneously, similar to the operation described at Block 1322 of FIG. 10. The sequential operation of one of the first light source and the second light source of the plurality of light sources may, for example, be carried out using the computerized device. The method 1500 may then end at Block 1599.

In some embodiments, a system capable of performing the method 1500 of FIG. 12 may further be capable of identifying and defining two or patterns within a target surface, akin to methods 1100 of FIG. 8, 1200 of FIG. 9, and 1400 of FIG. 11. For the second defined pattern the computerized device may be configured to determine whether the pattern comprises two or more regions, such as third and fourth regions, having a third surface scatter profile that reflects light within a third wavelength range or comprises a third region having a third surface scatter profile that reflects light within a third wavelength range and a fourth region having a fourth surface scatter profile that reflects light within a fourth wavelength range.

If the computerized device determines the second defined pattern comprises two or more regions, such as third and fourth regions, having a third surface scatter profile that reflects light within a third wavelength range, the color matching engine may be configured to perform a matching operation that operates to determine a third dominant wavelength of the third wavelength range. Furthermore, the color matching engine may be configured to determine a variety of polychromatic lights selectively including and/or excluding dominant wavelengths associated with each of the first and second defined patterns. For example, where the first defined pattern comprises only a first dominant wavelength, the color matching engine may determine a first polychromatic light comprising the first dominant wavelength and excluding the third dominant wavelength, a second polychromatic light comprising the third dominant wavelength and excluding the first dominant wavelength, a third polychromatic light comprising each of the first and third dominant wavelengths, and a fourth polychromatic light excluding both of the first and third dominant wavelengths. Furthermore, the computerize device may be configured to operate the plurality of luminaires to selectively emit the first, second, third, and fourth polychromatic lights in any sequence.

As another example, where the first defined pattern comprises first and second dominant wavelengths, the color matching engine may determine a first polychromatic light comprising the first dominant wavelength and excluding each of the second and third dominant wavelengths, a second polychromatic light comprising the second dominant wavelength and excluding each of the first and third dominant wavelengths, a third polychromatic light comprising the third dominant wavelength and excluding each of the first and second dominant wavelengths, a fourth polychromatic light comprising each of the first and third dominant wavelengths and excluding the second dominant wavelength, a fifth polychromatic light comprising each of the second and third dominant wavelengths and excluding the first dominant wavelength, and a sixth polychromatic light excluding each of the first, second, and third dominant wavelengths. Furthermore, the computerized device may be configured to operate the plurality of luminaires to selectively emit the first, second, third, fourth, fifth, and sixth polychromatic lights in any sequence.

If the computerized device determines the second defined pattern comprises a third region having a third surface scatter profile that reflects light within a third wavelength range and a fourth region having a fourth surface scatter profile that reflects light within a fourth wavelength range, then the color matching engine may be configured to perform a color matching operation that operates to determine a third dominant wavelength associated with the third wavelength range and a fourth dominant wavelength associated with the fourth wavelength range. Additionally, the color matching engine may be configured to determine a variety of polychromatic lights selectively including and/or excluding dominant wavelengths associated with each of the first and second defined patterns.

Some of the many permutations of polychromatic lights that may be determined based on the number of dominant wavelengths comprised by two or more patterns are described above. Any and all combinations of any number of patterns having any number of dominant wavelengths associated therewith are contemplated and included within the scope of the invention. Furthermore, the emission of any sequence of the various polychromatic lights as may be determined are also contemplated and included within the scope of the invention.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A lighting system for accenting a region of a target surface comprising:

a color matching engine;

a plurality of light sources;

a color capture device; and a computerized device operatively coupled to each of the color matching engine, the plurality of light sources, and the color capture device, and configured to individually operate each of the plurality of light sources;

wherein the computerized device is configured to operate the plurality of light sources to emit an analysis light so as to be incident upon a target surface;

wherein the color capture device is configured to measure light reflected by the target surface;

wherein the computerized device is configured to identify a region of the target surface that reflects two or more wavelength ranges of light using a pattern recognition algorithm, defining a detected pattern comprising a first region having a first surface scatter profile associated with a first wavelength range and a second region having a second surface scatter profile associated with a second wavelength range;

wherein the color matching engine is configured to perform a matching operation that operates to determine a first dominant wavelength of the first wavelength range and a second dominant wavelength of the second wavelength range, and to determine a first polychromatic light including the first dominant wavelength and excluding the second dominant wavelength, and a second polychromatic light including the second dominant wavelength and excluding the first dominant wavelength; and wherein the computerized device is configured to operate the plurality of light sources to emit sequential combined lights comprising each of the first polychromatic light and the second polychromatic light emitted in sequence.

2. The lighting system according to claim 1 wherein each light source comprises a plurality of light-emitting diodes (LEDs).

3. The lighting system according to claim 1 wherein the combined lights are white lights.

4. The lighting system according to claim 1 wherein the computerized device is configured to operate the plurality of luminaires so as to sequentially emit the combined lights to comprise first the first polychromatic light for a first duration and to comprise second the second polychromatic light for a second duration; and wherein a length of each of the first duration and the second duration is selected so as to simulate motion in a transition between the first region and the second region.

5. The lighting system according to claim 1 wherein:

the detected pattern is defined as a first detected pattern;

the computerized device is configured to identify a pattern of the target surface that reflects light outside the wavelength ranges associated with the first detected pattern using the pattern recognition algorithm, defining a second detected pattern comprising a third region having a third surface scatter profile associated with a third wavelength range and a fourth region having a fourth surface scatter profile associated with a fourth wavelength range; and the color matching engine is configured to perform a matching operation that operates to determine a third dominant wavelength of the third wavelength range and a fourth dominant wavelength of the fourth wavelength range.

6. The lighting system according to claim 5 wherein the color matching engine is configured to determine a first polychromatic light including the first and third dominant wavelengths and excluding the second and fourth dominant wavelengths, and a second polychromatic light including the second and fourth dominant wavelengths and excluding the first and third dominant wavelengths.

7. The lighting system according to claim 5 wherein:

the color matching engine is configured to:

determine a first polychromatic light including the first dominant wavelength and excluding each of the second, third, and fourth dominant wavelengths, determine a second polychromatic light including the second dominant wavelength and excluding each of the first, third, and fourth dominant wavelengths, determine a third polychromatic light including the third dominant wavelength and excluding each of the first, second, and fourth dominant wavelengths, and determine a fourth polychromatic light including the fourth dominant wavelength and excluding each of the first, second, and third dominant wavelengths; and the computerized device is configured to operate the plurality of light sources to emit combined lights comprising sequentially each of the first polychromatic light, the second polychromatic light, the third polychromatic light, and the fourth polychromatic light.

8. The lighting system according to claim 7 wherein the computerized device is configured to operate the plurality of luminaires so as to sequentially emit a sequence of combined lights comprising the first polychromatic light for a first duration, the second polychromatic light for a second duration, the third polychromatic light for a third duration, and the fourth polychromatic light for a fourth duration; and wherein a length of each of the first duration, second duration, third duration, and fourth duration are selected so as to simulate motion in a transition between any of the first region, the second region, the third region, and the fourth region.

9. A lighting system for accenting a region of a target surface comprising:

a color matching engine;

a plurality of light sources, the plurality of light sources comprising a first light source positioned at a first location and a second light source positioned at a second location;

a color capture device; and a computerized device operatively coupled to each of the color matching engine, the plurality of light sources, and the color capture device, and configured to individually operate each of the plurality of light sources;

wherein the computerized device is configured to operate the plurality of light sources to emit an analysis light so as to be incident upon a target surface;

wherein the color capture device is configured to measure light reflected by the target surface;

wherein the computerized device is configured to identify a pattern of the target surface that reflects light within a wavelength range of light using a pattern recognition algorithm, defining a detected pattern having a first region and a second region having a first surface scatter profile associated with a first wavelength range;

wherein the color matching engine is configured to perform a matching operation that operates to determine a first dominant wavelength of the first wavelength range, and to determine a first polychromatic light including the first dominant wavelength and a second polychromatic light excluding the first dominant wavelength;

wherein light emitted by the first light source is not incident upon the second region and light emitted by the second light source is not incident upon the first region;

wherein the computerized device is configured to selectively operate the first light source and the second light source such that one of the first light source and the second light source emits the first polychromatic light while the other emits the second polychromatic light.

10. The lighting system according to claim 9 wherein each light source comprises a plurality of light-emitting diodes (LEDs).

11. The lighting system according to claim 9 wherein each of the first polychromatic light and the second polychromatic light is a white light.

12. The lighting system according to claim 9 wherein the computerized device is configured to sequentially operate the first and second light sources such that:

first, the first light source emits the first polychromatic light and the second light source emits the second polychromatic light for a first duration, and second, the first light source emits the second polychromatic light and the second light source emits the first polychromatic light for a second duration;

wherein a length of each of the first duration and the second duration is selected so as to simulate motion in a transition between the first region and the second region.

13. The lighting system according to claim 9 wherein:

the detected pattern is defined as a first detected pattern;

the computerized device is configured to identify a pattern of the target surface that reflects light within a wavelength range of using the pattern recognition algorithm, defining a second detected pattern comprising a third region and a fourth region having a second scatter profile associated with a second wavelength range; and the color matching engine is configured to perform a matching operation that operates to determine a second dominant wavelength of the second wavelength range.

14. The lighting system according to claim 13 wherein:

the color matching engine is configured to determine a first polychromatic light including the first dominant wavelength and excluding the second dominant wavelength, a second polychromatic light including each of the first and second dominant wavelengths, a third polychromatic light including the second dominant wavelength and excluding the first dominant wavelength, and a fourth polychromatic light excluding each of the first and second dominant wavelengths;

light emitted by the first light source is incident upon the first and third regions and not incident upon the second and fourth regions;

light emitted by the second light source is incident upon the second and fourth regions and not incident upon the first and third regions; and the computerized device is configured to selectively operate the first light source and the second light source such that:

one of the first light source and the second light source emits the first polychromatic light while the other emits the fourth polychromatic light simultaneously, one of the first light source and the second light source emits the second polychromatic light while the other emits the fourth polychromatic light simultaneously, and one of the first light source and the second light source emits the third polychromatic light while the other emits the fourth polychromatic light simultaneously.

15. A lighting system for accenting a region of a target surface comprising:

a color matching engine;

a plurality of light sources, the plurality of light sources comprising a first light source positioned at a first location and a second light source positioned at a second location;

a color capture device; and a computerized device operatively coupled to each of the color matching engine, the plurality of light sources, and the color capture device, and configured to individually operate each of the plurality of light sources;

wherein the computerized device is configured to operate the plurality of light sources to emit a polychromatic analysis light so as to be incident upon a target surface;

wherein the color capture device is configured to measure light reflected by the target surface;

wherein the computerized device is configured to identify a region of the target surface that reflects light that is definable as a pattern using a pattern recognition algorithm, defining a detected pattern;

wherein the computerized device is configured to determine if the detected pattern comprises a first region and a second region configured to reflect light within a first wavelength range or comprises a first region configured to reflect light within a first wavelength range and a second region configured to reflect light within a second wavelength range;

wherein if the computerized device determines the detected pattern comprises first and second regions configured to reflect light within a same first wavelength range:

the color matching engine is configured to perform a matching operation that operates to determine a first dominant wavelength of the first wavelength range, and to determine a first polychromatic light including the first dominant wavelength and a second polychromatic light excluding the first dominant wavelength, and the computerized device is configured to selectively operate the first light source and the second light source such that one of the first light source and the second light source emits the first polychromatic light while the other emits the second polychromatic light; and wherein if the computerized device determines the detected pattern comprises a first region configured to reflect light within a first wavelength range and a second region configured to reflect light within a second wavelength range:

the color matching engine is configured to perform a matching operation that operates to determine a first dominant wavelength of the first wavelength range and a second dominant wavelength of the second wavelength range, and to determine a first polychromatic light including the first dominant wavelength and excluding the second dominant wavelength, and a second polychromatic light including the second dominant wavelength and excluding the first dominant wavelength, and the computerized device is configured to operate the plurality of light sources to emit one of the first polychromatic light and the second polychromatic light.

16. The lighting system according to claim 15 wherein each light source comprises a plurality of light-emitting diodes (LEDs).

17. The lighting system according to claim 15 wherein each of the first polychromatic light and the second polychromatic light is a white light.

18. The lighting system according to claim 15 wherein if the computerized device determines the detected pattern comprises first and second regions configured to reflect light within the first wavelength range, the computerized device is configured to sequentially operate the first and second light sources such that:

first, the first light source emits the first polychromatic light and the second light source emits the second polychromatic light for a first duration, and second, the first light source emits the second polychromatic light and the second light source emits the first polychromatic light for a second duration; and wherein a length of each of the first duration and the second duration is selected so as to simulate motion in a transition between the first region and the second region.

19. The lighting system according to claim 15 wherein if the computerized device determines the detected pattern comprises a first region configured to reflect light within a first wavelength range and a second region configured to reflect light within a second wavelength range, the computerized device is configured to operate the plurality of luminaires so as to sequentially emit a sequence of combined lights first comprising the first polychromatic light for a first duration and second being the second polychromatic light for a second duration; and wherein a length of each of the first duration and the second duration is selected so as to simulate motion in a transition between the first region and the second region.

20. The lighting system according to claim 15 wherein:

the detected pattern is defined as a first pattern;

the computerized device is configured to identify a pattern of the target surface that reflects light within a second wavelength range of light using the pattern recognition algorithm, defining a second detected pattern;

the computerized device is configured to determine if the second detected pattern comprises a third region and a fourth region configured to reflect light within a third wavelength range or comprises a third region configured to reflect light within a third wavelength range and a fourth region configured to reflect light within a fourth wavelength range;

if the computerized device determines the second detected pattern comprises a third region configured to reflect light within a third wavelength range and a fourth region configured to reflect light within a fourth wavelength range, the color matching engine is configured to perform a matching operation that operates to determine a third dominant wavelength of the third wavelength range and a fourth dominant wavelength of the fourth wavelength range; and if the computerized device determines the second detected pattern comprises a third region and a fourth region configured to reflect light within a third wavelength range, the color matching engine is configured to perform a matching operation that operates to determine a third dominant wavelength of the third wavelength range.

* * * * *